US011091286B2

(12) United States Patent
Wood et al.

(10) Patent No.: US 11,091,286 B2
(45) Date of Patent: Aug. 17, 2021

(54) METHOD OF FORMING HEAT-SHRUNK PACKING WITH OPENING FEATURES

(71) Applicant: Sealed Air Corporation (US), Charlotte, NC (US)

(72) Inventors: Gary Wood, Pelham, NH (US); Joseph Beauregard, Dracut, MA (US); Russell Christman, Dunstable, MA (US); Mark A. Hood, Raleigh, NC (US)

(73) Assignee: Sealed Air Corporation (US), Charlotte, NC (US)

( * ) Notice: Subject to any disclaimer, the term of this patent is extended or adjusted under 35 U.S.C. 154(b) by 0 days.

(21) Appl. No.: 16/493,477

(22) PCT Filed: Mar. 15, 2018

(86) PCT No.: PCT/US2018/022648
§ 371 (c)(1),
(2) Date: Sep. 12, 2019

(87) PCT Pub. No.: WO2018/170274
PCT Pub. Date: Sep. 20, 2018

(65) Prior Publication Data

US 2020/0130879 A1 Apr. 30, 2020

Related U.S. Application Data

(60) Provisional application No. 62/472,059, filed on Mar. 16, 2017.

(51) Int. Cl.
*B65B 61/18* (2006.01)
*B65B 9/06* (2012.01)
(Continued)

(52) U.S. Cl.
CPC ..... *B65B 61/184* (2013.01); *B65B 9/06* (2013.01); *B65B 53/02* (2013.01); *B65D 75/5838* (2013.01); *B65D 2575/58* (2013.01)

(58) Field of Classification Search
CPC ..... B65B 9/06; B65B 9/067; B65B 9/207; B65B 53/02; B65B 53/04; B65B 53/06;
(Continued)

(56) References Cited

U.S. PATENT DOCUMENTS 4,653,250 A * 3/1987 Nakamura ..... B65B 9/073 493/213
4,658,963 A * 4/1987 Jud ..... B65D 75/585 229/87.05
(Continued)

FOREIGN PATENT DOCUMENTS

EP 0193130 A2 * 9/1986 ..... B65B 9/073
WO 2018026984 A1 2/2018

*Primary Examiner* — Stephen F. Gerrity
(74) *Attorney, Agent, or Firm* — Jon M. Isaacson

(57) ABSTRACT

A packaging system includes an object, a heat-shrinkable package, and a protective film. The heat-shrinkable package is formed from heat-shrinkable film around the object and the heat-shrinkable film includes a weakened portion. The protective film is coupled to the heat-shrinkable film and positioned to cover the weakened portion in the heat-shrinkable film. The heat-shrinkable package is configured to shrink and form a package of heat-shrunk film around the object in response to being exposed to a heat-shrink environment. The protective film is positioned to cover the weakened portion in the heat-shrunk film after exposing to package of heat-shrinkable film and the protective film to the heat-shrink environment.

10 Claims, 16 Drawing Sheets

(51) Int. Cl.
*B65B 53/02* (2006.01)
*B65D 75/58* (2006.01)

(58) Field of Classification Search
CPC ..... B65B 53/063; B65B 61/02; B65B 61/18; B65B 61/184
USPC ..... 53/412, 442, 133.3, 133.4, 133.8, 557
See application file for complete search history.

(56) References Cited

U.S. PATENT DOCUMENTS

| | | | | |
|---|---|---|---|---|
| 5,067,612 | A * | 11/1991 | Tsuchiya et al. | B65B 61/02 206/497 |
| 5,129,518 | A * | 7/1992 | Tanaka et al. | B65D 75/5827 206/497 |
| 5,240,111 | A * | 8/1993 | Yamashita et al. | B65D 33/01 206/497 |
| 5,413,412 | A | 5/1995 | Odabashian | |
| 6,880,313 | B1 * | 4/2005 | Gessford et al. | B65B 9/026 53/415 |
| 7,032,360 | B2 * | 4/2006 | Rutten et al. | B65B 61/02 53/399 |
| 7,416,521 | B2 * | 8/2008 | Forman et al. | B65B 61/184 493/377 |
| 8,156,715 | B2 * | 4/2012 | Nowak et al. | B65B 61/182 53/133.3 |
| 2003/0223656 | A1 * | 12/2003 | Razeti et al. | B65D 75/5833 383/66 |
| 2004/0083680 | A1 | 5/2004 | Compton et al. | |
| 2013/0121624 | A1 * | 5/2013 | Lyzenga et al. | B65B 61/184 383/203 |

* cited by examiner

METHOD OF FORMING HEAT-SHRUNK PACKING WITH OPENING FEATURES

BACKGROUND

The present disclosure is in the technical field of object packaging. More particularly, the present disclosure is directed to providing opening features on heat-shrunk packaging.

In many cases, objects are packaged for shipment in packaging that prevents the objects from been seen by third parties during shipment. For example, objects can be packaged in cardboard boxes, and the cardboard boxes are taped closed so that the boxes stay closed during shipment. The cardboard boxes protect the objects during shipment, such as protecting the objects from physical and cosmetic damage and protecting the objects from being viewed. Other forms of packaging are suitable for packaging objects and protecting them during shipment, such as rigid plastic containers, paper envelopes and mailers, plastic film bags (e.g., polyethylene-based film bags), and the like.

Some drawbacks to the use of packaging materials include the amount of waste created by these materials and the cost associated with these materials. For example, once a box has been used to ship an object, the box is often discarded. In addition, packaging often contains void fill material, such as crumpled paper dunnage, inflated air pouches, sheets of inflated cellular chambers, and the like. This void fill material is also typically discarded after a single shipment. In addition to creating waste, packaging materials and void fill materials have costs that add to the costs associated with shipping the objects.

One way to address some of these drawbacks is to use heat-shrinkable film to replace packaging materials and, possibly, to eliminate void fill materials. Many objects that are shipped include retail packaging that provides some measure of protection, such as boxes or plastic casing in which the objects are normally placed for display in retail environments. These objects, with their retail packaging, can be packaged in heat-shrinkable film and subjected to heat-shrink environments. In the heat-shrink environment, the heat-shrinkable film shrinks for form heat-shrunk film around the objects. The objects can be shipped with the heat-shrunk film providing protection for the object and, in the case of opaque heat-shrunk film, protection from being viewed during shipment. In this way, the use of heat-shrunk film may eliminate the need for shipping containers and void fill materials beyond those already included with the object (e.g., its retail packaging).

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one embodiment, a method is used to package an object. The method includes forming a package of heat-shrinkable film around an object, where the heat-shrinkable film including a weakened portion. The method further includes coupling a protective film to the heat-shrinkable film, where the protective film is positioned to cover the weakened portion in the heat-shrinkable film. The method further includes exposing the package of heat-shrinkable film and the protective film to a heat-shrink environment configured to cause the package of heat-shrinkable film to shrink and form a package of heat-shrunk film around the object. The protective film is positioned to cover the weakened portion in the heat-shrunk film after exposing to package of heat-shrinkable film and the protective film to the heat-shrink environment.

In one example, the heat-shrunk film is substantially opaque. In another example, the heat-shrinkable film and the protective film are formed from substantially the same material. In another example, the protective film is made from a material that shrinks less than the shrinkage of the heat-shrinkable film during exposure to the heat-shrink environment. In another example, forming the package of heat-shrinkable film around the object includes feeding the heat-shrinkable film in a Z-folded state having a major fold and a minor fold and forming a longitudinal seal between a first end of the heat-shrinkable film and the minor fold to form a tunnel of the heat-shrinkable film. In another example, the protective film is formed from the heat-shrinkable film between the minor fold and a second end of the heat-shrinkable film. In another example, the weakened portion is located in the heat-shrinkable film between the minor fold and the major fold under the protective film. In another example, the method further includes forming a transverse leading seal and a transverse trailing seal on opposite sides of the object, where each of the transverse leading seal and the transverse trailing seal seals a portion of the heat-shrinkable film between the first end and the major fold, a portion of the heat-shrinkable film between the major fold and the minor fold, and a portion of the heat-shrinkable film between the minor fold and the second end.

In another example, coupling the protective film to the heat-shrinkable film includes feeding the protective film along the heat-shrinkable film so that the protective film covers the weakened portion in the heat-shrinkable film before forming the package of heat-shrinkable film. In another example, forming the package of heat-shrinkable film around the object includes forming a transverse leading seal and a transverse trailing seal on opposite sides of the object, where the transverse leading seal seals a first end of the protective film to the heat-shrinkable film and wherein the transverse trailing seal seals a second end of the protective film to the heat-shrinkable film. In another example, the heat-shrinkable film and the protective film are formed from substantially the same material. In another example, the protective film is made from a material that shrinks less than the shrinkage of the heat-shrinkable film during exposure to the heat-shrink environment.

In another embodiment, a package includes an object, a heat-shrinkable package, and a protective film. The heat-shrinkable package is formed from heat-shrinkable film around the object and the heat-shrinkable film includes a weakened portion. The protective film is coupled to the heat-shrinkable film and positioned to cover the weakened portion in the heat-shrinkable film. The heat-shrinkable package is configured to shrink and form a package of heat-shrunk film around the object in response to being exposed to a heat-shrink environment. The protective film is positioned to cover the weakened portion in the heat-shrunk film after exposing to package of heat-shrinkable film and the protective film to the heat-shrink environment.

In one example, the heat-shrunk film is substantially opaque. In another example, the heat-shrinkable film and the protective film are formed from substantially the same material. In another example, the protective film is made from a material that shrinks less than the shrinkage of the heat-shrinkable film during exposure to the heat-shrink environment. In another example, the package of heat-shrinkable film and the protective film are formed from a Z-folded film having a major fold and a minor fold, where the package of heat-shrinkable film is formed from a first portion of the Z-folded film between a first end of the Z-folded film and the major fold and a second portion of the Z folded film between the major fold and the minor fold, and wherein the protective film is formed from a third portion of the Z-folded film between the minor fold and a second end of the Z-folded film. In another example, the package of heat-shrinkable film is formed from a first film, the protective film is formed from a second film, and the first and second films are coupled to each other at transverse seals located on opposite sides of the object.

In another example, a package includes a package and an adhesive backing. The package is formed from a heat-shrunk film and the package surrounds an object. The adhesive backing is adhered to an inner side of the package. The adhesive backing includes a film substrate, a first adhesive section, and a second adhesive section. The first adhesive section is applied longitudinally along the film substrate. The first adhesive section is adhered to the heat-shrunk film such that removal of the first adhesive section from the heat-shrunk film deforms the heat-shrunk film. The second adhesive section is applied longitudinally along the film substrate and transversely spaced apart from the first adhesive. The second adhesive section is adhered to heat-shrunk film such that removal of the second adhesive section from the heat-shrunk film does not substantially deform the heat-shrunk film.

In one example, the package further includes a removable liner applied longitudinally along the second adhesive section and located between the second adhesive section and the inner side of the heat-shrunk package, where the removable liner is narrower in a transverse direction than the second adhesive section. In another example, the package further includes a pull tab longitudinally applied to the film substrate between the first adhesive section and the second adhesive section, where the pull tab is configured to aid in breaking the heat-shrunk film when it is pulled from the film substrate. In another example, the package further includes a weakened portion in the heat-shrunk film, where the weakened portion is located in the heat-shrunk film longitudinally between a location where the first adhesive section is adhered to the heat-shrunk film and a location where the second adhesive section is adhered to the heat-shrunk film. In another example, the weakened portion includes at least one of a perforation, a score, or a slit. In another example, the heat-shrunk film and the film substrate are made from substantially the same material.

In another example a method of packaging an object includes feeding a supply of heat-shrinkable film and adhering an adhesive backing to the package. The adhesive backing includes a film substrate, a first adhesive section applied longitudinally along the film substrate, and a second adhesive section applied longitudinally along the film substrate and transversely spaced apart from the first adhesive. The method further includes forming the heat-shrinkable film into a tube with the adhesive backing on an inner side of the heat-shrinkable film, inserting an object into the tube of the heat-shrinkable film, and forming one or more seals in the tube of the heat-shrinkable film to form a heat-shrinkable package around the object.

In one example, the first adhesive section is adhered to the heat-shrunk film such that removal of the first adhesive section from the heat-shrunk film deforms the heat-shrunk film, and the second adhesive section is adhered to heat-shrunk film such that removal of the second adhesive section from the heat-shrunk film does not substantially deform the heat-shrunk film. In another example, the method further includes forming a weakened portion in the heat-shrinkable film, where adhering the adhesive backing to the package includes adhering the adhesive backing at a position where the first adhesive section and the second adhesive section are adhered to the heat-shrinkable film on opposite sides of the weakened portion in the heat-shrinkable film. In another example, the method further includes exposing the heat-shrinkable package to a heat-shrink environment configured to cause the heat-shrinkable package to shrink and form a heat-shrunk package around the object. In another example, the film substrate is configured to shrink at a shrinkage rate when exposed to the heat-shrink environment, and wherein the heat-shrinkable film in the heat-shrinkable package is configured to shrink substantially at the shrinkage rate.

In another embodiment, a package includes an object, a heat-shrunk package, and a notch. The heat-shrunk package is formed from heat-shrunk film around the object. The heat-shrunk film includes at least a first seal and a second seal that seal portions of the heat-shrunk film, wherein the first seal is wider than the second seal. The notch is formed in one the first and second seals. The notch is configured to permit the one the first and second seals to be broken to open the heat-shrunk package and to initiate propagation of a tear in the heat-shrunk film in response to the notch being pulled.

In one example, the notch extends from the one the first and second seals seal onto an unsealed portion of the heat-shrunk film. In another example, the notch includes a feature in the unsealed portion of the heat-shrunk film, and wherein the feature of the notch encourages propagation of the tear in the heat-shrunk film along the one the first and second seals. In another example, the notch has a triangular shape and the feature has a rectangular shape. In another example, the first seal is a longitudinal seal in the heat-shrunk package, and the notch is formed in the first seal. In another example, the first seal is a transverse seal in the heat-shrunk package, and wherein the notch is formed in the second seal. In another example, the notch is formed in the second seal, and the notch is configured to initiate propagation of the tear in the heat-shrunk film in a direction along the first seal in response to the notch being pulled from the first seal.

In another embodiment, a method of packaging an object includes feeding a supply of heat-shrinkable film, forming the heat-shrinkable film into a tube, inserting an object into the tube of the heat-shrinkable film, and forming the heat-shrinkable film into a heat-shrinkable package around the object. The heat-shrinkable package includes at least a first seal and a second seal and the first seal is wider than the second seal. The method further includes forming a notch in one of the first and second seals and exposing the heat-shrinkable package to a heat-shrink environment configured to cause the heat-shrinkable package to shrink and form a heat-shrunk package around the object. The notch remains in the one of the first and second seals after the heat-shrinkable package is formed into the heat-shrunk package. The notch is configured to permit the one of the first and second seals to be broken to initiate propagation of a tear in the heat-shrunk package in response to the notch being pulled.

In one example, forming the heat-shrinkable film into the tube includes forming a longitudinal seal in the heat-shrinkable film, and the longitudinal seal is the one of the first and second seals. In another example, forming the heat-shrinkable film into a heat-shrinkable package includes forming a transverse seal in the heat-shrinkable film, and the transverse seal is the one of the first and second seals. In another example, forming the notch in the first seal includes punching the notch in the one of the first and second seals. In another example, the notch is punched in the one of the first and second seals after the tube is formed and before the heat-shrinkable package is formed into the heat-shrunk package.

BRIEF DESCRIPTION OF THE DRAWING

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

The present disclosure describes embodiments of opening features on heat-shrunk packaging. More specifically, the opening features on heat-shrunk packaging may provide an easy method of opening the heat-shrunk packaging.

As noted above, an object can be packaged in heat-shrunk film for shipment. One drawback to shipping an object in heat-shrunk film packaging that has easy-to-open features is that the easy-to-open features may be inadvertently opened during shipping and/or handling. If the heat-shrunk film packaging opens during shipping, the heat-shrunk film packaging no longer provides some of the protections it is intended to provide. However, when the heat-shrunk film packaging has no opening feature, it is difficult for a shipping recipient to remove the heat-shrunk film without the use of cutting tools. There is a need for easy-to-open features in heat-shrunk film that are not likely to open during shipment.

In addition to providing easy-to-open features in heat-shrunk film that are not likely to open during shipment, it may also be beneficial to make the heat-shrunk film reusable. For example, a retail customer who receives an object in a shipment may want to return the object to the retailer. In these cases, it would be helpful if the heat-shrunk film packaging could be reused to ship the object back to the retailer for return. There is a need for packaging that can be opened and then reclosed and reused as a shipping container.

Figure 1:
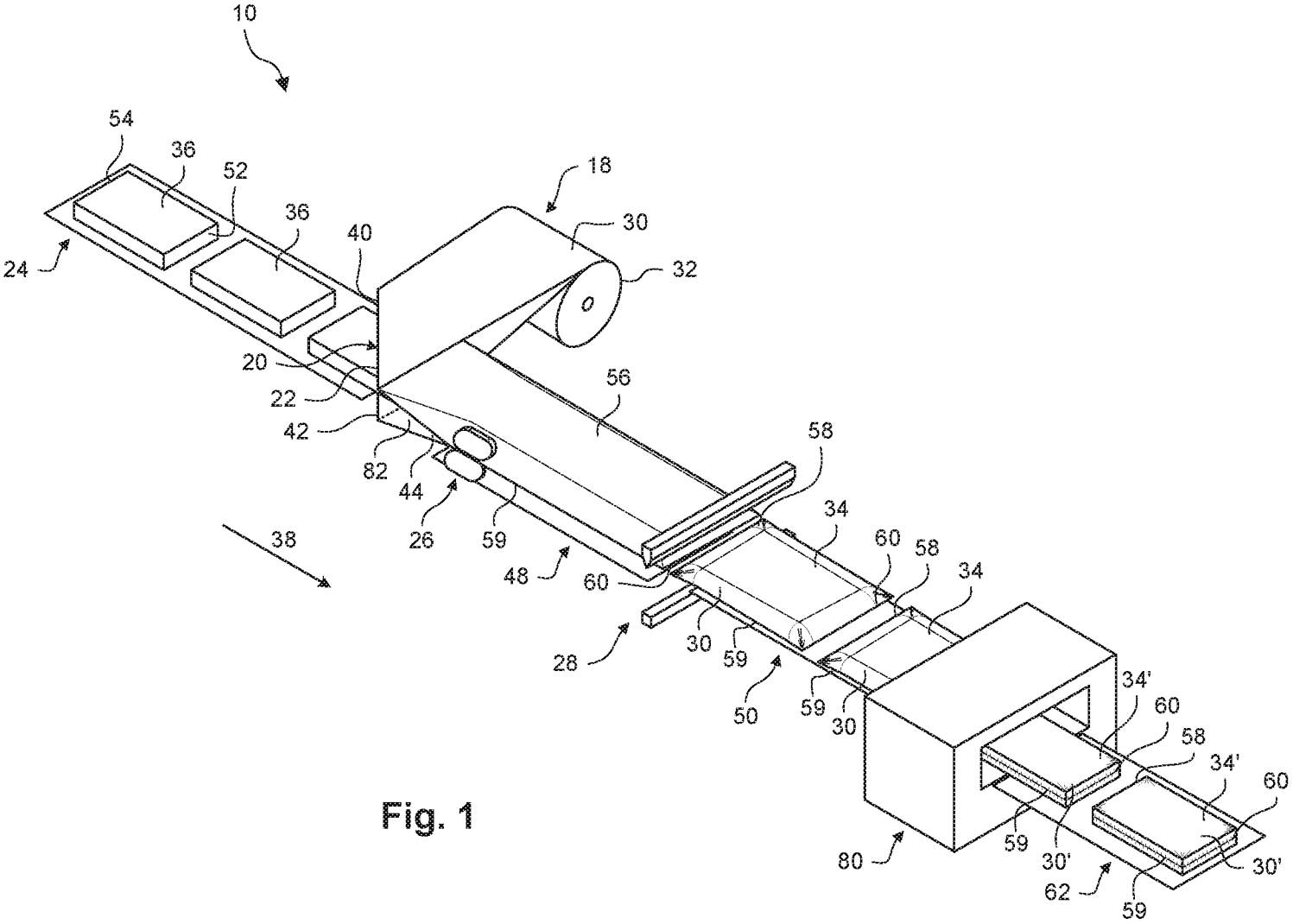
FIG. 1 depicts an embodiment of a packaging system, in accordance with the embodiments disclosed herein.

FIG. 1 depicts an embodiment of a shrink wrap packaging system 10. In the depicted embodiment, the packaging system 10 is a continuous shrink wrap packaging system that is capable of receiving a stream of objects, independently surrounding each of the objects with heat-shrinkable film, and then shrinking the heat-shrinkable film around the objects. In other embodiments, the packaging system 10 is a non-continuous packaging system. In the depicted embodiment, the packaging system 10 includes a shrink film dispenser 18, a transfer head 20 including an inverting head 22, an infeed conveyor 24, a longitudinal sealer 26, and an end sealer 28, as will be described in more detail below.

The shrink film dispenser 18 supplies a web of heat-shrinkable film 30 from roll 32. Systems for supplying webs of film are known in art and may include unwind mechanisms and other features. Heat-shrinkable films have the ability, upon being exposed to a certain temperature, to shrink or to generate shrink tension when used in a packaging application. Once a product is enclosed in the heat-shrinkable film, the packaged product is subjected to an elevated temperature, such as by subjecting the packaged object to a hot fluid, such as hot air or hot water. This causes the film to shrink and form a tight wrap surrounding the enclosed packaged product. In some embodiments, heat-shrinkable film may be opaque. Embodiments of opaque shrink films are described in U.S. Application No. 62/370, 258, entitled "Opaque, Heat Shrinkable Microlayer Film", the contents of which are hereby incorporated by references in their entirety.

As used herein, the term "opaque" may be defined in terms of one or more of total luminous transmittance, opacity, or contrast ratio opacity. Total luminous transmittance may be defined as the percentage of luminous flux that passes through a film when visible light is transmitted at the film. In some embodiments, a film is opaque if the film has a total luminous transmittance that is at or below any one of the following values: 10%, 20%, 30%, 40%, 50%, 60%, 65%, 70%, 75%, 80%, 85%, and 90%, measured in accordance with ASTM D1003. Opacity may be defined as the percentage of luminous flux that does not pass through a film when visible light is transmitted at the film. Opacity may be defined according to the formula 100%−total transmittance=opacity. In some embodiments, a film is opaque if the film has a total luminous transmittance that is at or above any one of the following values: 10%, 20%, 30%, 40%, 50%, 60%, 65%, 70%, 75%, 80%, 85%, and 90%. Contrast ratio opacity measurement characterizes how opaque a film sample is using two readings: a Y (luminance or brightness) value measured with the film sample backed by a black background and a Y value measured with the film sample backed by a white background. The resulting fraction is expressed as Y %, calculated as follows:

$$\text{Opacity}(Y) = \frac{Y_{black\ backing}}{Y_{white\ backing}} \times 100$$

In some embodiments, a film is opaque if the contrast ratio opacity for the film is at least, and/or at most, any one of the following values: 10%, 20%, 30%, 40%, 50%, 60%, 65%, 70%, 75%, 80%, 85%, and 90%, calculated per above with base values measured in accordance with ASTM D1746.

In some embodiments, the heat-shrinkable film 30 on the roll 32 is a center-folded film. In other embodiments, the heat-shrinkable film 30 on roll 32 is a flat wound film. In some embodiments, the heat-shrinkable film 30 includes any sheet or film material suitable for packaging objects 36, in particular for heat-shrinkable packages 34 for use as packaging for an object. Suitable materials include polymers, for example thermoplastic polymers (e.g., polyethylene), that are suitable for heat sealing and/or heat shrinking. In some embodiments, the heat-shrinkable film 30 has a thickness of any of at least 3, 5, 7, 10, and 15 mils; and/or at most any of 25, 20, 16, 12, 10, 8, 6 and 5 mils. In some embodiments, the heat-shrinkable film 30 is multilayered, and has an outer layer adapted for heat sealing the heat-shrinkable film to itself to form a seal.

The transfer head 20 of the packaging system 10 receives the web of heat-shrinkable film 30 from the shrink film dispenser 18. The transfer head 20 is adapted to manage (e.g., form) the web of heat-shrinkable film 30 into a configuration for eventual sealing into a tube. In the depicted embodiment, the transfer head 20 is an inverting head 22 of continuous flow wrap that receives the web of heat-shrinkable film 30. The heat-shrinkable film 30 is center-folded from the shrink film dispenser 18 and redirects the web of film over the top and bottom inverting head arms 40 and 42 to travel in a conveyance direction 38 by turning the web of heat-shrinkable film 30 inside out. In this manner, the transfer head 20 is adapted to manage the heat-shrinkable film 30 to provide an interior space 44 bounded by the heat-shrinkable film 30.

In some embodiments, the transfer head 20 in the configuration of a forming box receives the lay flat web of heat-shrinkable film 30 from the shrink film dispenser 18 and redirects the web of film over the forming head to travel in the conveyance direction 38 by turning the web of heat-shrinkable film 30 inside out. In this manner, the transfer head 20 is adapted to manage the web of heat-shrinkable film 30 to provide an interior space 44 bounded by heat-shrinkable film 30.

The infeed conveyor 24 of the packaging system 10 is adapted to transport a series of objects 36 and sequentially deliver them in the conveyance direction 38. In some embodiments, the infeed conveyor 24 is adapted to convey a series of objects 36. In the embodiment depicted in FIG. 1, the objects 36 have a similar size. In other embodiments, the objects 36 have varied or differing sizes. Within the series of objects 36 in sequential order, a "preceding" object is upstream from a "following" object. The infeed conveyor 24 is configured to deliver in repeating fashion a preceding object upstream from a following object into the interior space 44 of the web of heat-shrinkable film 30. In some embodiments, the objects 36 are delivered in spaced or gapped arrangement from each other.

An "object," as used herein, may comprise a single item for packaging, or may comprise a grouping of several distinct items where the grouping is to be in a single package. Further, an object may include an accompanying informational item, such as a packing slip, tracking code, a manifest, an invoice, or printed sheet comprising machine-readable information (e.g., a bar code) for sensing by an object reader (e.g., a bar code scanner).

Downstream from the infeed conveyor 24 is an object conveyor 48, which is adapted to support and transport the web of heat-shrinkable film 30 and the object 36 downstream together to the end sealer 28. A first discharge conveyor 50 transports the series of packages 34 from the end sealer 28.

As each object 36 of the series of objects sequentially travels through the packaging system 10, its position within the machine is tracked. This is accomplished by ways known in the art. For example, an infeed eye system (horizontal or vertical) determines the location of the front edge 52 of each object and the location of the rear edge 54 of each object as the object travels along the conveyor. This location information is communicated to a controller (i.e., a programmable logic controller or "PLC"). A system of encoders and counters, also in communication with the PLC, determines the amount of travel of the conveyor on which the object is positioned. In this manner, the position of the object 36 itself is determined and known by the PLC. The PLC is also in communication with the end sealer 28 to provide the object position information for a particular object to these unit operations.

In the depicted embodiment, the longitudinal sealer 26 is adapted to continuously seal the open side of the heat-shrinkable film 30 together in a longitudinal seal 59 to form a tube 56 enveloping one of the objects 36. In the depicted embodiment, the longitudinal sealer 26 is located at side of the tube 56, where the longitudinal sealer 26 forms a side seal between two edge portions of the heat-shrinkable film 30. In other embodiments, the longitudinal sealer 26 may be located beneath the tube 56, where the sealer may form, for example, a center fin seal between two edge portions of the web of the heat-shrinkable film 30. As two edge portions of the heat-shrinkable film 30 are brought together at the longitudinal sealer 26 to form the tube 56, they are sealed together, for example, by a combination of heat and pressure, to form a continuous fin or a longitudinal seal 59. Appropriate longitudinal sealers are known in the art, and include, for example, heat sealers.

The end sealer 28 is adapted to provide or perform in repeating fashion, while the tube 56 is traveling: (i) a trailing end seal 58 that is transverse to the tube 56 and upstream from a preceding object to create a heat-shrinkable package 34 and (ii) a leading end seal 60 transverse to the tube 56 and downstream from a following object. Further, the end sealer 28 is adapted to sever the heat-shrinkable package 34 from the tube 56 by cutting between the trailing end seal 58 and the leading end seal 60. Generally, the end sealer 28 uses temperature and/or pressure to make two seals (trailing end seal 58 and leading end seal 60) and cuts between them, thus creating the final, trailing seal of one finished, preceding package and the first, leading end seal of the following package. Advantageously, the end sealer 28 may be adapted to simultaneously sever the heat-shrinkable package 34 from the tube 56 while providing the trailing end seal 58 and leading end seal 60.

Useful end sealer units are known in the art. These include, for example, rotary type of end sealer units, having matched heated bars mounted on rotating shafts. As the film tube passes through the rotary type, the rotation is timed so it coincides with the gap between objects. A double seal is produced and the gap between the two seals is cut by an integral blade to separate individual packs. Another type of end seal unit is the box motion type, having a motion that describes a "box" shape so that its horizontal movement increases the contact time between the seal bars and the film. Still another type of end sealer unit is the continuous type, which includes a sealing bar that moves down with the tube 56 while sealing.

The first discharge conveyor 50 transports the series of packages 34 from the end sealer 28 to a heat-shrink system 80. The heat-shrink system 80 is configured to raise the temperature of the packages to cause the heat-shrinkable film 30 of the packages 34 to shrink around the objects 36 to form heat-shrunk packages 34' of heat-shrunk film 30'. In some embodiments, the heat-shrink system 80 is configured to subject the packages 34 to a hot fluid, such as hot air or hot water, in order to cause the heat-shrinkable wrap of the packages 34 to shrink around the objects 36. The packaging system 10 further includes a second discharge conveyor 62 configured to transport the heat-shrunk packages 34' from the heat-shrink system 80.

One benefit to the use of opaque heat-shrink films is the ability to minimize the amount of packaging material used to package the objects 36. For example, one of the objects 36 can be packaged into the heat-shrunk package 34' and the object 36 can be shipped in the heat-shrunk package 34' without any further protective packaging (e.g., foam cushioning, exterior cardboard boxes, etc.). This is especially the case where the object includes its own packaging (e.g., the object includes a product packaged with cushioning inside a container). One of the difficulties with shipping the object 36 in the heat-shrunk package 34' is opening the heat-shrunk package 34' after it has been shipped. Examples of opening the heat-shrunk package 34' are depicted in FIGS. 2A and 2B.

Figure 2A:
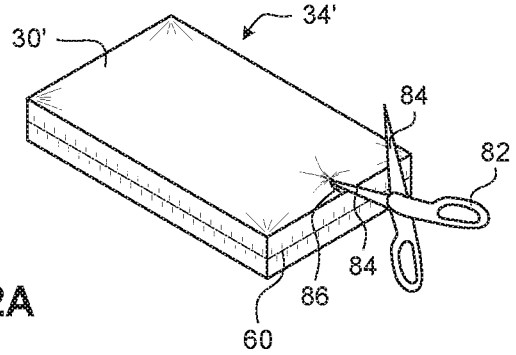
FIGS. 2A and 2B depict examples of opening a heat-shrunk package, in accordance with the embodiments disclosed herein.

In FIG. 2A, scissors 82 with a pair of blades 84 are used to open the heat-shrunk package 34'. One of the blades 84 has been used to poke a hole 86 in the heat-shrunk film 30'. From the instance depicted in FIG. 2A, one or both of the blades 84 can further cut the heat-shrunk film 30' until the object 36 is able to be removed from the heat-shrunk package 34'.

Figure 2B:
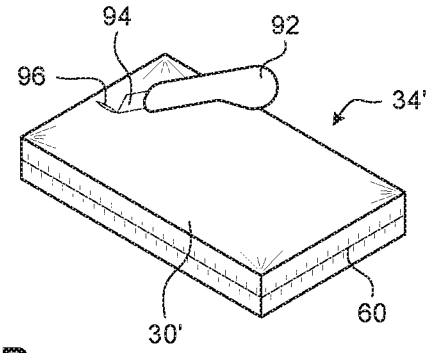

In FIG. 2B, a box cutter 92 with a blade 94 is used open the heat-shrunk package 34'. The blade 94 has been used to form a slit 96 in the heat-shrunk film 30'. From the instance depicted in FIG. 2B, the blade 94 can be pulled across the heat-shrunk film 30' to further cut the heat-shrunk film 30' until the object 36 is able to be removed from the heat-shrunk package 34'.

In both of the examples shown in FIGS. 2A and 2B, the blades 84 and/or the blade 94 can damage the object 36. For example, the blade 84 and/or the blade 94 can scratch the object 36, poke a hole in the object 36, or otherwise damage the object 36. This is particularly problematic in the case where no void fill material or cushioning material is located between the heat-shrunk film 30' and the object 36, making it difficult for the heat-shrunk film 30' to be cut without damaging the object 36. It would be advantageous for the heat-shrunk package 34' to be opened without the use of cutting tools, such as the scissors 82 or the box cutter 92.

Figure 3:
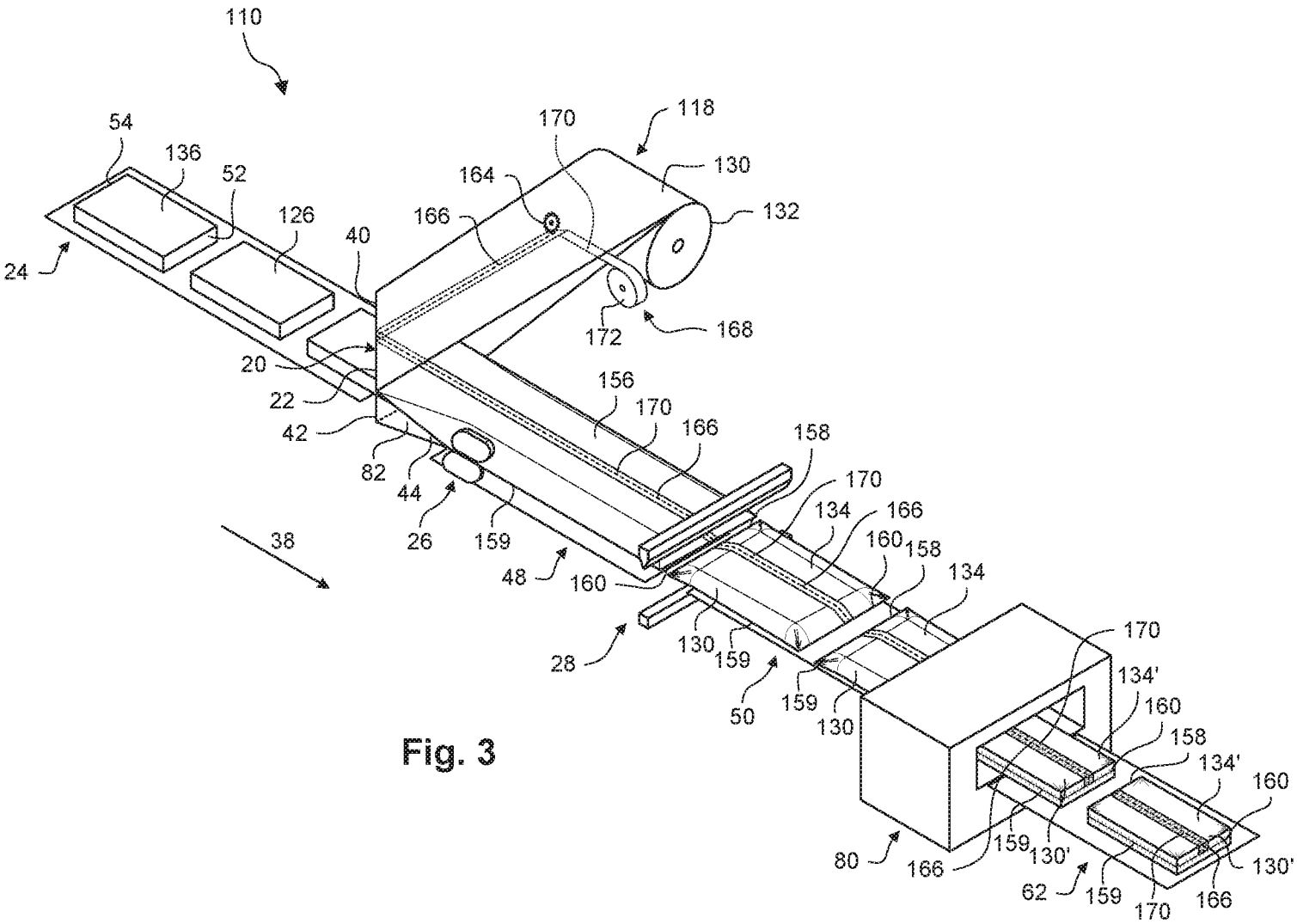
FIG. 3 depicts an embodiment of a packaging system configured to form an opening feature in heat-shrunk packages, in accordance with the embodiments disclosed herein.

FIG. 3 depicts an embodiment of a packaging system 110 configured to form an opening feature in heat-shrunk packages. The packaging system 110 includes a number of components that are common to the components of the packaging system 10, and those components in common are similarly numbered in both the packaging system 10 and the packaging system 110. The packaging system 110 includes a shrink film dispenser 118 that supplies a web of heat-shrinkable film 130 from roll 132. In the depicted embodiment, the heat-shrinkable film 130 on the roll 132 is a center-folded film.

The packaging system 110 includes a weakening element 164 that forms a weakened portion 166 in the heat-shrinkable film 130. In some examples, the weakened portion 166 includes one or more of a perforated line (i.e., a line of periodic slits), a continuous slit, a score line (i.e., a line that is cut partially through the film), an area the heat-shrinkable film 130 with reduced strength from exposure to a particular form of electromagnetic radiation, or any other form of weakening of the heat-shrinkable film 130. In some embodiments, the heat-shrinkable film 130 is more likely to break or tear at that location of the weakened portion 166 than at other locations. This is particularly the case when pulling forces are applied on either side of the weakened portion 166 in directions away from the weakened portion 166. In the depicted embodiment, the heat-shrinkable film 130 is center-folded and the weakened portion 166 in the top side of the center-folded heat-shrinkable film 130.

The packaging system 110 also includes a tape dispenser 168 that supplies a web of adhesive tape 170 from a roll 172. In the depicted embodiment, the adhesive tape 170 has adhesive on one side of the adhesive tape 170. In some embodiments, the adhesive is exposed on at least a portion of the one side or on the entirety of the one side. In the depicted embodiment, the heat-shrinkable film 130 is center-folded and the adhesive tape 170 is adhered to the lower surface of the top side of the center-folded heat-shrinkable film 130 along the weakened portion 166. In some embodiments, the adhesive tape 170 is adhered across the weakened portion 166 or adhered on one side of the weakened portion 166. In some embodiment, the adhesive tape 170 is configured to aid in breaking or tearing the weakened portion 166 when the adhesive tape 170 is pulled.

The heat-shrinkable film 130 is inverted at the transfer head 20. The longitudinal sealer 26 creates a longitudinal seal 159 to form a tube 156. The adhesive tape 170 is located on top of the tube 56 of the heat-shrinkable film 130 and the adhesive tape 170 is located over the weakened portion 166. The adhesive tape 170 remains on top of the heat-shrinkable film 130 over the weakened portion 166 when a package 134 is formed. The formation of the leading end seal 60 and the trailing end seal 58 in the heat-shrinkable film 130 by the end sealer 28 also causes the adhesive tape 170 to be cut. This leaves a strip of the adhesive tape 170 covering the weakened portion 166 on the package 134. As the package 134 passes through the heat-shrink system 80, the heat-shrink environment within the heat-shrink system 80 causes the heat-shrinkable film 130 of the packages 134 to shrink around the objects 136 to form heat-shrunk packages 134' of heat-shrunk film 130'. In some embodiments, the adhesive tape 170 does not shrink as much as the heat-shrinkable film 130 shrinks when exposed to the heat-shrink environment. This difference in shrinkage rates may cause rippling of the adhesive tape 170 when the heat-shrunk packages 134' are formed, but the adhesive tape 170 can still be used to tear or break the weakened portion 166 when it is pulled even if it is rippled. In this way, the combination of the weakened portion 166 and the adhesive tape 170 forms an opening feature that may make it easier for recipients of the heat-shrunk packages 134' to open them.

Depicted in FIGS. 4A to 4D are partial cross-sectional views of examples of the adhesive tape 170 applied over the weakened portion 166 of the heat-shrinkable film 130. As noted above, the adhesive tape 170 can adhered across the weakened portion 166 or adhered on one side of the weakened portion 166. As also noted above, the adhesive tape 170 is a one-sided adhesive tape and the adhesive is exposed on at least a portion of the one side or on the entirety of the one side of the adhesive tape 170. In the embodiment shown in FIG. 4A, the adhesive is exposed across the entire lower side of the adhesive tape 170 and the adhesive tape 170 is adhered to the heat-shrinkable film 130 over the entire width of the adhesive tape 170. The adhesive tape 170 can be pulled from one end of the heat-shrunk package 134' (e.g., from the leading end seal 60 or from the trailing end seal 58) to cause the weakened portion 166 to break or tear.

Figure 4B:
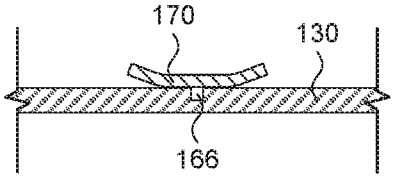
FIGS. 4A to 4D depict partial cross-sectional views of examples of an adhesive tape applied over a weakened portion of a heat-shrinkable film, in accordance with the embodiments disclosed herein.

In the embodiment shown in FIG. 4B, adhesive is exposed across an inner portion of the lower side of the adhesive tape 170 and the outer portions do not have exposed adhesive. The adhesive tape 170 is adhered over a portion of the width of the adhesive tape 170 across the weakened portion 166. The sides of the adhesive tape 170 that do not have exposed adhesive may naturally rise away from the heat-shrinkable film 130 (as depicted in FIG. 4B). This can also be the case after the heat-shrunk film 130' is formed, particularly if the adhesive tape 170 is rippled. The portion of the adhesive tape 170 that naturally rises away from the heat-shrinkable film 130 or the heat-shrunk film 130' may provide a grasping point for a user to grasp and pull the adhesive tape 170. Pulling the adhesive tape 170 can cause the weakened portion 166 to break or tear.

Figure 4D:
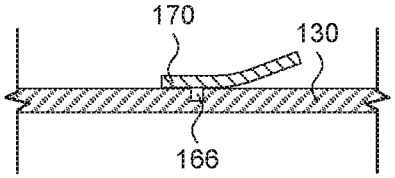
Figure 4A:
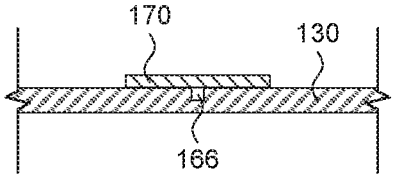
Figure 4C:
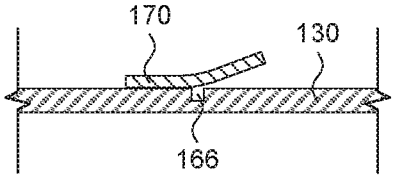

In the embodiments shown in FIGS. 4C and 4D, the adhesive is exposed across the left portion of the lower side of the adhesive tape 170 and right portion does not have exposed adhesive. In FIG. 4C, the adhesive tape 170 is adhered to the side of the weakened portion 166. In FIG. 4D, the adhesive tape 170 is adhered across the weakened portion 166. In both embodiments shown in FIGS. 4C and 4D, the right side of the adhesive tape 170 that does not have exposed adhesive may naturally rise away from the heat-shrinkable film 130. The right side may even more naturally rise if the adhesive tape 170 is rippled after the heat-shrinkable film 130 is formed into heat-shrunk film 130'. The portion of the adhesive tape 170 that naturally rises away from the heat-shrinkable film 130 or the heat-shrunk film 130' may provide a grasping point for a user to grasp and pull the adhesive tape 170. Pulling the adhesive tape 170 can cause the weakened portion 166 to break or tear.

The combination of the weakened portion 166 and the adhesive tape 170 forms an opening feature for the heat-shrunk package 134' that may permit a recipient of the heat-shrunk package 134' to open the heat-shrunk package 134' without the use of tools, such as scissors or box cutters. One difficulty with the combination of the weakened portion 166 and the adhesive tape 170 on the heat-shrunk package 134' is that the ease with which the adhesive tape 170 can be pulled to break or tear the weakened portion 166. This easy-open ability may result in the heat-shrunk package 134' being opened inadvertently. For example, during handling in a shipping facility (e.g., sorting) or during shipment to a recipient, the adhesive tape 170 may inadvertently be caught (e.g., in sorting machinery) and pulled sufficiently to cause the weakened portion 166 to tear or break. Described herein are embodiments of heat-shrunk packages with opening features that are covered by a protective film to hinder inadvertent opening of the opening features.

Figure 5B:
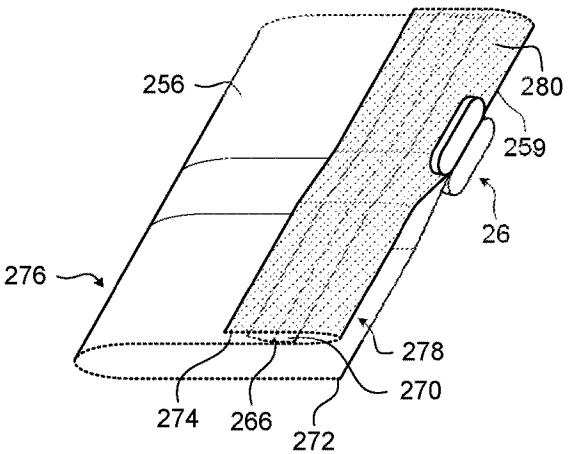
FIGS. 5A and 5B depict, respectively, an embodiment of a packaging system configured to form an opening feature in heat-shrunk packages that is covered by a protective film and a partial cross-sectional view of the heat-shrinkable film after it has been inverted at the transfer head, in accordance with the embodiments disclosed herein.
Figure 5A:
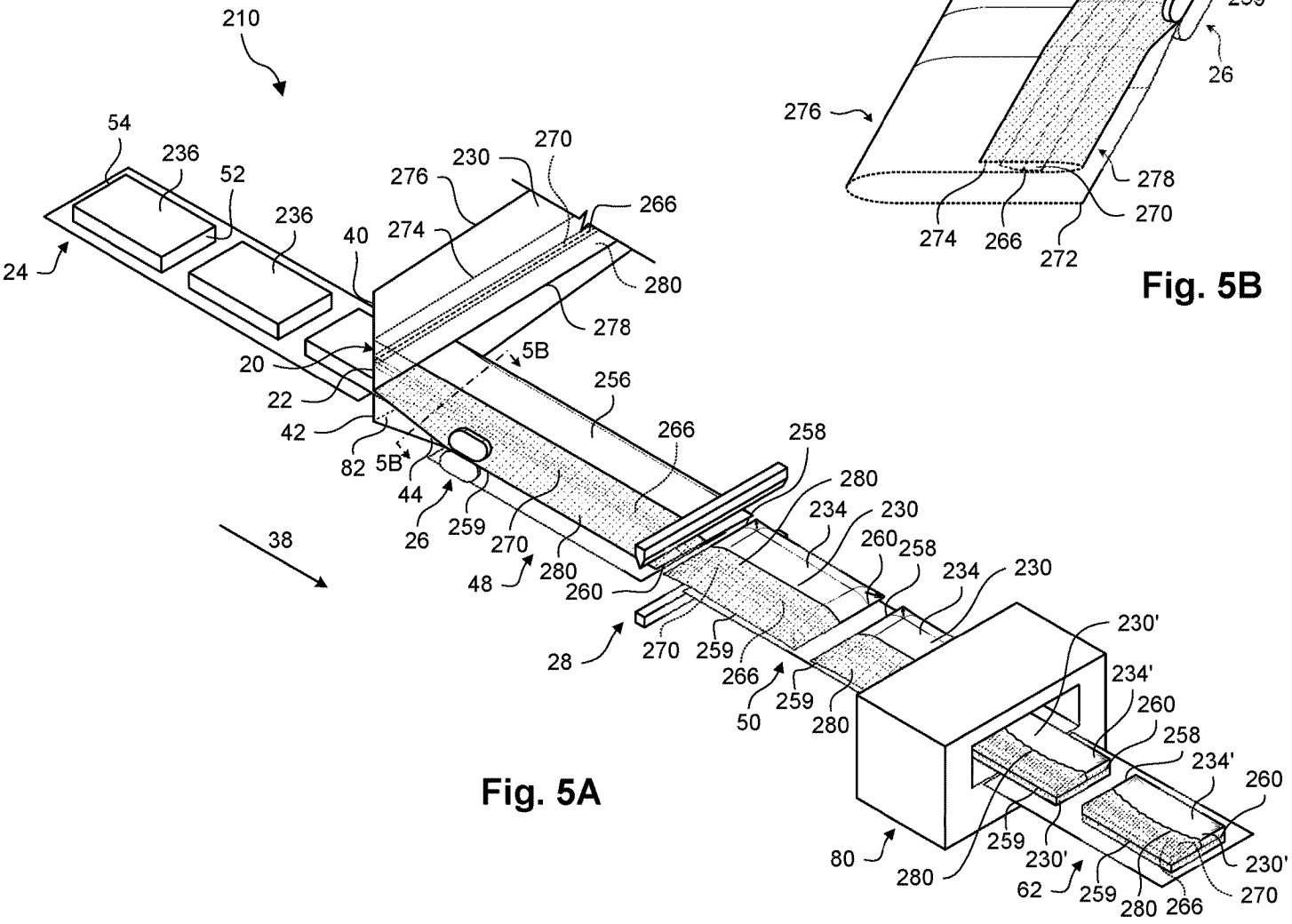

FIG. 5A depicts an embodiment of a packaging system 210 configured to form an opening feature in heat-shrunk packages that is covered by protective film. The packaging system 210 includes a number of components that are common to the components of the packaging system 10, and those components in common are similarly numbered in both the packaging system 10 and the packaging system 210. The packaging system 210 includes a web of heat-shrinkable film 230 being fed, such as being fed from a supply roll. In the depicted embodiment, the heat-shrinkable film 230 is a Z-folded film.

The heat-shrinkable film 230 includes a weakened portion 266. In some examples, the weakened portion 266 is formed by a weakening element as the heat-shrinkable film 230 is fed. In some examples, the weakened portion 266 includes one or more of a perforated line (i.e., a line of periodic slits), a continuous slit, a score line (i.e., a line that is cut partially through the film), an area the heat-shrinkable film 230 with reduced strength from exposure to a particular form of electromagnetic radiation, or any other form of weakening of the heat-shrinkable film 230. In some embodiments, the heat-shrinkable film 230 is more likely to break or tear at that location of the weakened portion 266 than at other locations.

In the depicted embodiment, the heat-shrinkable film 230 also includes an adhesive tape 270. The adhesive tape 270 has adhesive on one side. In some embodiments, the adhesive is exposed on at least a portion of the one side or on the entirety of the one side. In the depicted embodiment, the heat-shrinkable film 230 has a first end 272 and a second end 274. The heat-shrinkable film 230 is Z-folded having a major fold 276 and a minor fold 278 between the first end 272 and the second end 274. The adhesive tape 270 is adhered along the weakened portion 266 on the portion of the heat-shrinkable film 230 between the major fold 276 and the minor fold 278. In some embodiments, the adhesive tape 270 is adhered across the weakened portion 266 or adhered on one side of the weakened portion 266. While adhesive tape may be used with some embodiments of weakened portions, including the embodiment shown in FIG. 5A, other embodiments of the heat-shrinkable film 230 do not include the adhesive tape 270.

The longitudinal sealer 26 creates a longitudinal seal 259 between the first end 272 and the minor fold 278. A tube 258 of the heat-shrinkable film 230 is formed between the major fold 276 and the longitudinal seal 259. A portion of the heat-shrinkable film 230 between the minor fold 278 and the second end 274 forms a protective film 280. As the heat-shrinkable film 230 is being fed to the transfer head 20, the protective film 280 is located under the portion of the heat-shrinkable film 230 between the major fold 276 and the minor fold 278. A partial cross-sectional view of the heat-shrinkable film 230 after it has been inverted at the transfer head 20 is shown in FIG. 5B. After inversion of the heat-shrinkable film 230 at the transfer head 20, as depicted in FIG. 5B, the protective film 280 is above the weakened portion 266 and the adhesive tape 270. In the embodiments shown in FIGS. 5A and 5B, the protective film 280 is shaded to distinguish it from the other portions of the heat-shrinkable film 230. However, the heat-shrinkable film 230 can be a substantially uniform material, such as an opaque heat-shrinkable film.

The tube 256 of the heat-shrinkable film 230 is formed into packages 234 by the creation of the leading end seal 260 and the trailing end seal 258 in the heat-shrinkable film 230 by the end sealer 28. The formation of the leading end seal 260 and the trailing end seal 258 causes the adhesive tape 270 and the protective film 280 to be cut. Each of the leading end seal 260 and the trailing end seal 258 seals the portion of the heat-shrinkable film 230 between the first end 272 and the major fold 276, the portion of the heat-shrinkable film 230 between the major fold 276 and the minor fold 278, and the portion of the heat-shrinkable film 230 between the minor fold 278 and the second end 274. This leaves the protective film 280 covering the weakened portion 266 with the protective film 280 coupled to the packages 234 at the leading end seal 260, the trailing end seal 258, and the longitudinal seal 259.

As the package 234 passes through the heat-shrink system 80, the heat-shrink environment within the heat-shrink system 80 causes the heat-shrinkable film 230 of the heat-shrinkable packages 234 to shrink around the objects 36 to form heat-shrunk packages 234' of heat-shrunk film 230'. Because the protective film 280 and the heat-shrinkable packages 234 are formed from substantially the same material (i.e., the heat-shrinkable film 230), the protective film 280 and the heat-shrinkable packages 234 tend to shrink at substantially similar shrinkage rates when exposed to the heat-shrink environment within the heat-shrink system 80. However, because of the protective film 280 is coupled to the packages 234 only on some of the sides of the protective film 280 (e.g., at the leading end seal 260, the trailing end seal 258, and the longitudinal seal 259), some rippling of the protective film 280 may occur during the heat-shrink process in the heat-shrink system 80.

As can be seen in the heat-shrunk packages 234' in FIG. 5A, the protective film 280 covers the weakened portion 266 when the heat-shrunk packages 234' are formed. The protective film 280 hinders any inadvertent breaking or tearing of the weakened portion 266 during handling, shipping, or any other situation. Despite the inclusion of the protective film 280 on the heat-shrunk packages 234', the heat-shrunk packages 234' can still be opened without the use of tools, such as scissors or box cutters. The protective film 280 may also permit the heat-shrunk packages 234' to be reused for shipping after they have been opened. An embodiment of opening the heat-shrunk package 234' and repackaging it after it has been opened is depicted in a series of instances in FIGS. 6A to 6D.

Figure 6A:
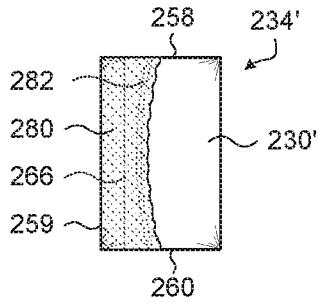
FIGS. 6A to 6D depict a series of instances of an embodiment of opening a heat-shrunk package and repackaging it after it has been opened, in accordance with the embodiments disclosed herein.

In the embodiment shown in FIG. 6A, the heat-shrunk package 234' is closed with the heat-shrunk film 230' surrounding the object 236. The protective film 280 covers the weakened portion 266. The protective film 280 is also coupled to the heat-shrunk package at the leading end seal 260, the trailing end seal 258, and the longitudinal seal 259. As noted above, not all embodiments of the heat-shrunk packages 234' include an adhesive tape 270 along the weakened portion 266. In the embodiment depicted in FIG. 6A, the heat-shrunk package 234' does not include the adhesive tape 270. In the state shown in FIG. 6A, the heat-shrunk package 234' can be sent to and received by a recipient.

Figure 6B:
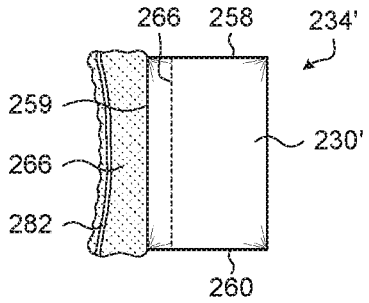

The recipient may pull back the protective film 280 from instance shown in FIG. 6A to the instance shown in FIG. 6B. Pulling back the protective film 280 may include tearing portions of the protective film 280 substantially parallel to the leading end seal 260 and the trailing end seal 258, while leaving the protective film 280 sealed to the heat-shrunk package 234' along the longitudinal seal 259. In the instance shown in FIG. 6B, the weakened portion 266 is exposed. As can also be seen in FIG. 6B, the protective film 280 may include an adhesive strip 282, such as an adhesive covered by a release liner.

Figure 6C:
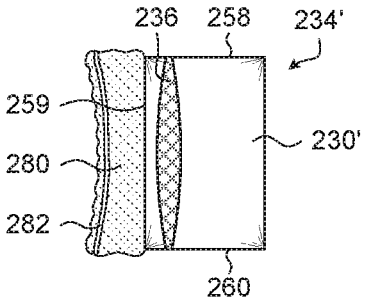

The recipient may then open the heat-shrunk package 234' from the instance shown in FIG. 6B by breaking or tearing the weakened portion 266 to the opened state depicted in FIG. 6C. In FIG. 6C, a portion of the object 236 is visible through the aperture where the weakened portion 266 was broken or torn. From the point depicted in FIG. 6C, the recipient may further open the aperture where the weakened portion 266 was broken or torn so that the object 36 can be removed from the heat-shrunk package 234'. Alternatively, from the point depicted in FIG. 6C, the recipient may determine that the object 36 should be returned to the sender and reclose the heat-shrunk package 234'.

Figure 6D:
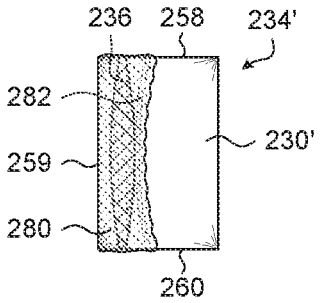

The reclosed heat-shrunk package 234' is depicted in FIG. 6D. More specifically, the protective film 280 is replaced back over the aperture where the weakened portion 266 was broken or torn. The adhesive strip 282 is adhered to the heat-shrunk film 230' of the heat-shrunk package 234' so that the protective film 280 covers the aperture. In some embodiments, the adhesive strip 282 is prepared prior to replacing the protective film 280 (e.g., by removing a release liner) so that the adhesive strip 282 can be adhered to the heat-shrunk film 230' of the heat-shrunk package 234'. With the heat-shrunk package 234' in a closed state, as depicted in FIG. 6D, the heat-shrunk package 234' can be used to ship the object 236 again, such as shipping the object 236 back to the sender of the heat-shrunk package 234'.

Figure 7:
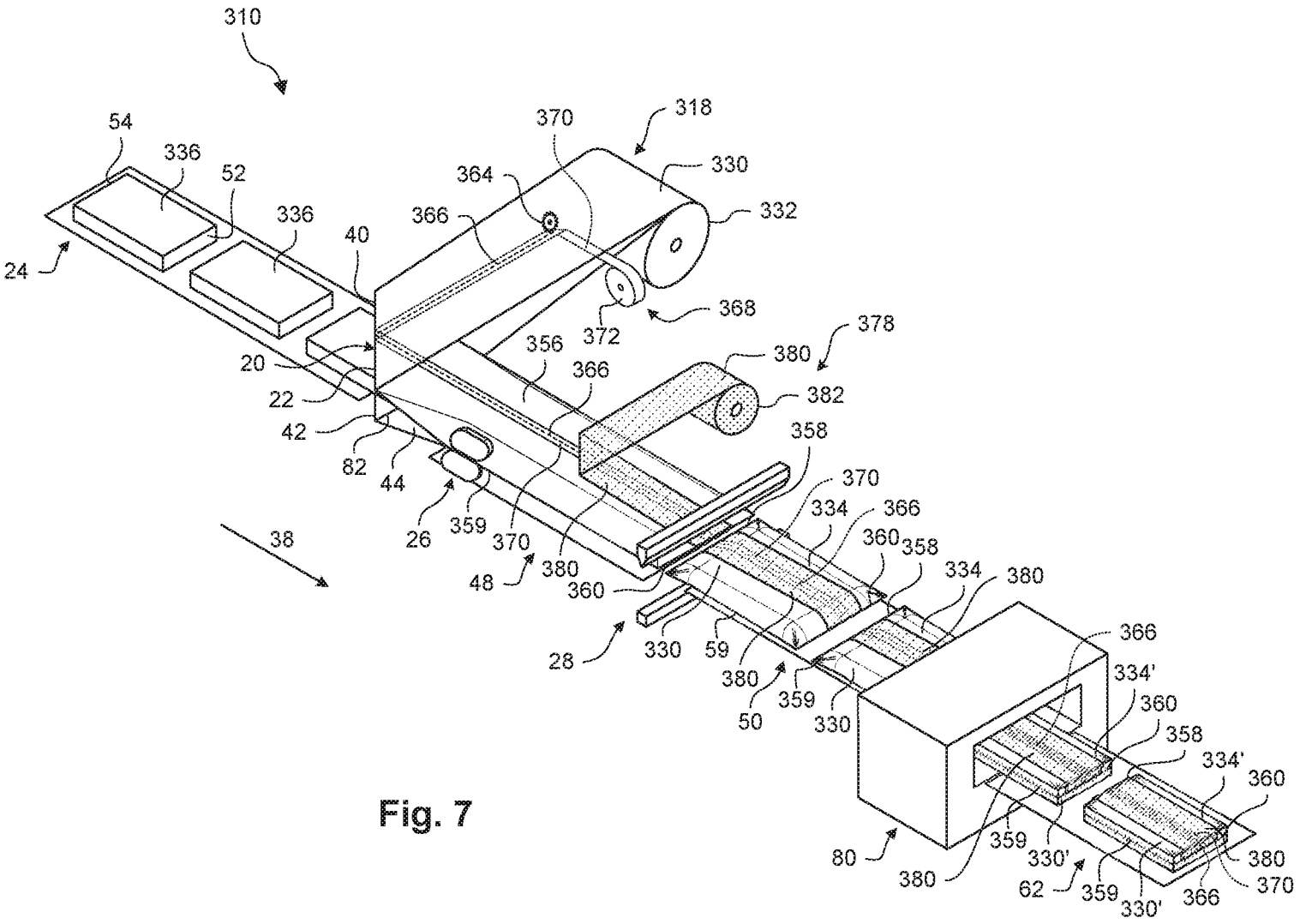
FIG. 7 depicts another embodiment of a packaging system configured to form an opening feature in heat-shrunk packages that is covered by a protective film, in accordance with the embodiments disclosed herein.

Depicted in FIG. 7 is another embodiment of a packaging system 310 configured to form an opening feature in heat-shrunk packages that is covered by a protective film. The packaging system 310 includes a number of components that are common to the components of the packaging system 10, and those components in common are similarly numbered in both the packaging system 10 and the packaging system 310. The packaging system 310 includes a shrink film dispenser 318 that supplies a web of heat-shrinkable film 330 from roll 332. In the depicted embodiment, the heat-shrinkable film 330 on the roll 332 is a center folded film.

The packaging system 310 includes a weakening element 364 that forms a weakened portion 366 in the heat-shrinkable film 330. In some examples, the weakened portion 366 includes one or more of a perforated line (i.e., a line of periodic slits), a continuous slit, a score line (i.e., a line that is cut partially through the film), an area the heat-shrinkable film 330 with reduced strength from exposure to a particular form of electromagnetic radiation, or any other form of weakening of the heat-shrinkable film 330. In some embodiments, the heat-shrinkable film 330 is more likely to break or tear at that location of the weakened portion 366 than at other locations, particularly when pulling forces are applied on either side of the weakened portion 366 in directions away from the weakened portion 366. In the depicted embodiment, the heat-shrinkable film 330 is center-folded and the weakened portion 366 in the top side of the center-folded heat-shrinkable film 330.

The packaging system 310 also includes a tape dispenser 388 that supplies a web of adhesive tape 370 from a roll 372. In the depicted embodiment, the adhesive tape 370 has adhesive on one side. In some embodiments, the adhesive is exposed on at least a portion of the one side or on the entirety of the one side. In the depicted embodiment, the heat-shrinkable film 330 is center-folded and the adhesive tape 370 is adhered to the lower surface of the top side of the center-folded heat-shrinkable film 330 along the weakened portion 366. In some embodiments, the adhesive tape 370 is adhered across the weakened portion 366 or adhered on one side of the weakened portion 366. In some embodiments, the adhesive tape 370 is configured to aid in breaking or tearing the weakened portion 366 when the adhesive tape 370 is pulled. As the heat-shrinkable film 330 is inverted at the transfer head 20, the adhesive tape 370 is located on top of the tube 356 of the heat-shrinkable film 330 and the adhesive tape 370 is located over the weakened portion 366. While the adhesive tape may be used in some embodiments, including the embodiment shown in FIG. 7, other embodiments of the heat-shrinkable film 330 do not include the adhesive tape 370.

The packaging system 310 includes a protective film dispenser 378 that supplies a web of protective film 380 from roll 382. In the depicted embodiment, the protective film 380 on the roll 382 is unfolded. The protective film dispenser 378 is arranged to feed the protective film 380 so that it covers the weakened portion 366 in the tube 356 of the heat-shrinkable film 330. In some embodiments, the protective film 380 is made from a material that shrinks less than the shrinkage of the heat-shrinkable film during exposure to the heat-shrink environment of the heat-shrink system 80. In other embodiments, the heat-shrinkable film 330 and the protective film 380 have substantially the same shrinkage rate when exposed to the heat-shrink environment.

As shown in FIG. 7, the weakened portion 366 remains on top of the heat-shrinkable film 330 in the tube 356 before the a package 334 is formed. The formation of the leading end seal 360 and the trailing end seal 358 in the heat-shrinkable film 330 by the end sealer 28 also causes the protective film 380 to be cut. This leaves a strip of the adhesive tape 370 covering the weakened portion 366 on the package 334. In the embodiments shown in FIG. 7, the protective film 380 is shaded to distinguish it from the other portions of the heat-shrinkable film 330. In some embodiments, both the heat-shrinkable film 330 and the protective film 380 are substantially opaque. In other embodiments, the protective film 380 is substantially transparent to make the weakened portion 366 visible while the heat-shrinkable film 330 is substantially opaque.

The tube 356 of the heat-shrinkable film 330 is formed into packages 334 by the creation of the leading end seal 360 and the trailing end seal 358 in the heat-shrinkable film 330 by the end sealer 28. The formation of the leading end seal 360 and the trailing end seal 358 causes the adhesive tape 370 and the protective film 380 to be cut. Each of the leading end seal 360 and the trailing end seal 358 seals portions of the heat-shrinkable film 330 and the protective film 380 to each other. This leaves the protective film 380 covering the weakened portion 366 with the protective film 380 coupled to the packages 334 at the leading end seal 360 and the trailing end seal 358.

As the package 334 passes through the heat-shrink system 80, the heat-shrink environment within the heat-shrink system 80 causes the heat-shrinkable film 330 of the packages 334 to shrink around the objects 336 to form heat-shrunk packages 334' of heat-shrunk film 330'. Some rippling of the protective film 380 may occur during the heat-shrink process in the heat-shrink system 80 due to differences in the materials of the heat-shrinkable film 330 and the protective film 380. Some rippling of the protective film 380 may also occur due to the protective film 380 not being coupled to the heat-shrinkable film 330 on all sides of the protective film 380.

As can be seen in the heat-shrunk packages 334' in FIG. 7, the protective film 380 covers the weakened portion 366 when the heat-shrunk packages 334' are formed. The protective film 380 hinders any inadvertent breaking or tearing of the weakened portion 366 during handling, shipping, or any other situation. Despite the inclusion of the protective film 380 on the heat-shrunk packages 334', the heat-shrunk packages 334' can still be opened without the use of tools, such as scissors or box cutters.

In the embodiments described above, a protective film covers a weakened portion in a heat-shrunk package to protect the weakened portion from unintentional opening. In other embodiments, a weakened portion may be protected by an adhesive backing that is located inside of the heat-shrunk package. Such an adhesive backing may reduce the probability of the weakened portion from unintentional opening and/or be reclosable to permit the heat-shrunk package to be easily reclosed in the event of an unintentional opening.

Figure 8A:
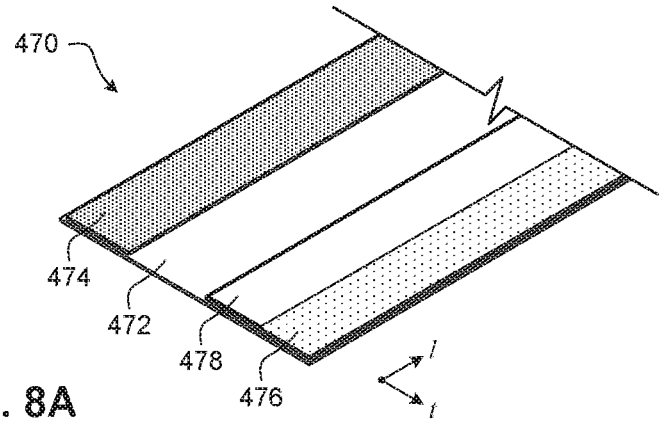
FIGS. 8A and 8B depict, respectively, an embodiment of an adhesive backing and a partial view of an embodiment of the adhesive backing adhered to a heat-shrinkable film, in accordance with the embodiments disclosed herein.

Depicted in FIG. 8A is an embodiment of an adhesive backing 470. The adhesive backing 470 includes a film substrate 472. In some embodiments, the film substrate 472 is formed from a heat-shrinkable material. In other embodiments, the film substrate 472 is formed from a material that does not shrink substantially when being exposed to a heat-shrink environment. The adhesive backing 470 includes a first adhesive section 474 that is applied longitudinally along the film substrate 472. In the depiction shown in FIG. 8A, the longitudinal direction is generally shown as the I-direction and the transverse direction is generally shown as the t-direction. In some embodiments, the longitudinally-applied first adhesive section 474 is substantially parallel to the length of the film substrate 472. The adhesive backing 470 also includes a second adhesive section 476 that is applied longitudinally along the film substrate 472 and is spaced apart transversely from the first adhesive section 474. In some embodiments, the longitudinally-applied second adhesive section 476 is substantially parallel to the length of the film substrate 472 and to the first adhesive section 474. In some embodiments, the first and second adhesive sections 474 and 476 are transversely spaced apart from each other so that a portion of the film substrate 472 is exposed between the first and second adhesive sections 474 and 476, as shown in FIG. 8A.

In some embodiments, the first and second adhesive sections 474 and 476 are double-sided adhesive tapes with an adhesive one side (e.g., the bottom side in FIG. 8A) to adhere the first and second adhesive sections 474 and 476 to the film substrate 472 and an adhesive on the other side of the first and second adhesive sections 474 and 476 (e.g., the top side in FIG. 8A). In some embodiments, including the embodiment shown in FIG. 8A, the adhesive is exposed on the sides of the first and second adhesive sections 474 and 476 opposite the film substrate 472 (e.g., the top side in FIG. 8A). As will be described in greater detail below, the exposed adhesive can be applied to a film, such as a heat-shrinkable film that is formed into a heat-shrinkable package. In some embodiments, the exposed adhesive on the sides of the first and second adhesive sections 474 and 476 opposite the film substrate 472 have different adhesive strengths. In some embodiments, the exposed adhesive on the first adhesive section 474 has a greater adhesive strength than the exposed adhesive on the second adhesive section 476. In some embodiments, after the exposed adhesives on the first adhesive section 474 is adhered to a film, the first adhesive section 474 has an adhesive strength such that removal of the first adhesive section 474 from the film deforms the film. In some embodiments, after the exposed adhesive on the second adhesive section 476 is adhered to a film, the second adhesive section 476 has an adhesive strength such that removal of the second adhesive section 476 from the film does not substantially deform the film. When used in combination, the first adhesive section 474 can be considered a "permanent adhesive" because the first adhesive section 474 is configured to remain adhered to the film unless the film is deformed and the second adhesive section 476 can be considered a "reclosable adhesive" because the second adhesive section 476 is configured to be removed from the film without deforming the film. In some embodiments, the reclosable adhesive of the second adhesive section 476 is configured to permit the film to be removed from the second adhesive section 476 and then re-adhered to the second adhesive section 476 multiple times while maintaining at least some adhesive strength.

As is depicted in FIG. 8A, the adhesive backing 470 also includes a removable liner 478 applied longitudinally along the second adhesive section 476. The removable liner 478 is narrower than the second adhesive section 476 in the transverse direction. As shown in the depicted embodiment, the narrower nature of the removable liner 478 leaves an area of the second adhesive section 476 exposed outside of the removable liner 478 in the longitudinal direction. The inclusion of the removable liner 478 in the adhesive backing 470 is optional, but can be useful if the adhesive backing 470 is used in a reclosable package, as discussed in greater detail below.

Figure 8B:
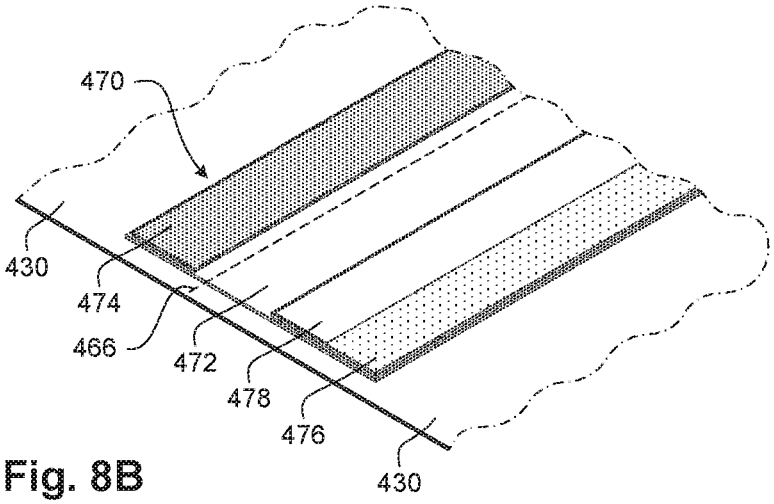

Depicted in FIG. 8B is a partial view of an embodiment of the adhesive backing 470 adhered to a heat-shrinkable film 430. The heat-shrinkable film 430 includes a weakened portion 466. In the depicted embodiment, the weakened portion 466 is a perforated line. In other embodiments, the weakened portion 466 is a score line, a slit, or any other weakened portion in the heat-shrinkable film 430. In the depicted embodiment, the adhesive backing 470 is adhered to the lower side of the heat-shrinkable film 430. In the depicted embodiment, the weakened portion 466 is located in the heat-shrinkable film 430 longitudinally between a location where the first adhesive section 474 is adhered to the heat-shrinkable film 430 and a location where the second adhesive section 476 is adhered to the heat-shrinkable film 430. In this way, the first adhesive section 474 and the second adhesive section 476 are on opposite sides of the weakened portion 466. In some embodiments, the first and second adhesive sections 474 and 476 are located with respect to the weakened portion 466 so that the weakened portion 466 is closer to the first adhesive section 474 than to the second adhesive section 476. As is also shown in FIG. 8B, when the adhesive backing 470 includes the removable liner 478, the removable liner 478 can be located between the second adhesive section 476 and the lower side of the heat-shrinkable film 430.

In some embodiments, the heat-shrinkable film 430 and the film substrate 472 are made from substantially the same material. In this way, the heat-shrinkable film 430 and the film substrate 472 will shrink at substantially similar heat shrinkage rates when exposed to a heat-shrink environment. In some cases, the film substrate 472 and/or the heat-shrinkable film 430 will exhibit rippling after being exposed to a heat-shrink environment. This rippling can be due, in part, to differences in heat-shrinkage rates of materials that are coupled to each other, such as a different in heat shrinkage rate of the heat-shrinkable film 430 and the heat-shrinkage rates of the first and second adhesive sections 474 and 476. In some embodiments, the rippling effect can be reduced by forming the heat-shrinkable film 430 and the film substrate 472 from substantially the same material so that they have substantially similar heat shrinkage rates.

Figure 8C:
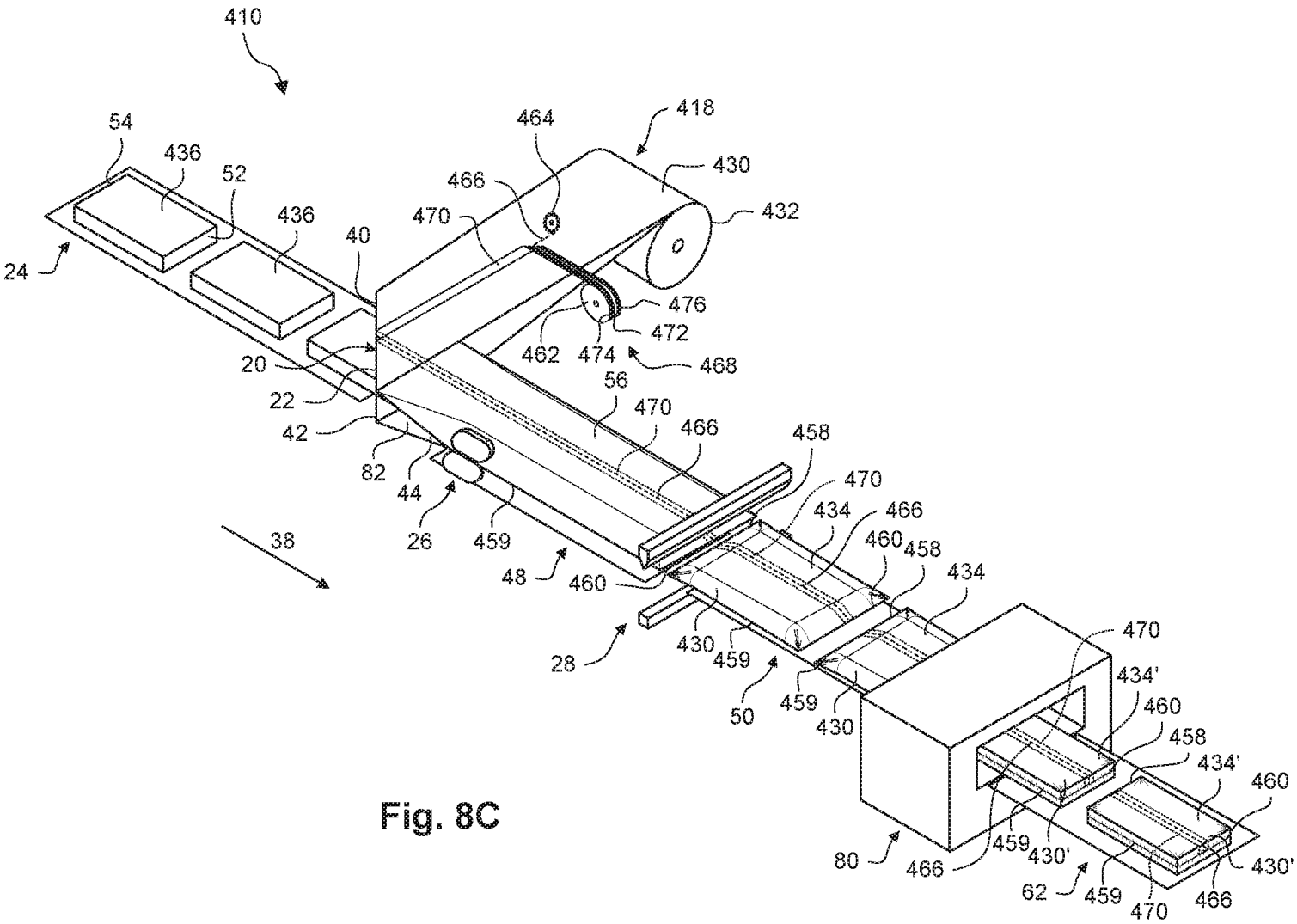
FIG. 8C depicts an embodiment of a packaging system configured to form heat-shrunk packages that include an adhesive backing, in accordance with the embodiments disclosed herein.

The adhesive backing 470 can be used with the heat-shrinkable film 430 to form heat-shrunk packages around objects. FIG. 8C depicts an embodiment of a packaging system 410 configured to form heat-shrunk packages that include an adhesive backing. The packaging system 410 includes a number of components that are common to the components of the packaging system 10, and those components in common are similarly numbered in both the packaging system 10 and the packaging system 410. The packaging system 410 includes a shrink film dispenser 418 that supplies a web of the heat-shrinkable film 430 from roll 432. In the depicted embodiment, the heat-shrinkable film 430 on the roll 432 is a center-folded film.

The packaging system 410 includes a weakening element 464 that forms the weakened portion 466 in the heat-shrinkable film 430. In the depicted embodiment, the heat-shrinkable film 430 is center-folded and the weakened portion 466 is in the top side of the center-folded heat-shrinkable film 430. The packaging system 410 also includes a tape dispenser 468 that supplies a web of the adhesive backing 470 from a roll 462. In the depicted embodiment, the adhesive backing 470 includes the film substrate 472, the first adhesive section 474, and the second adhesive section 476. Each of the first and second adhesive sections 474 and 476 is adhered longitudinally to the film substrate 472 and has exposed adhesive on the outer side of the roll 462. In some embodiments, the removable liner 478 is applied longitudinally along the second adhesive section 476.

In the depicted embodiment, the heat-shrinkable film 430 is center-folded and the adhesive backing 470 is adhered to the upper surface of the top side of the center-folded heat-shrinkable film 430 across the weakened portion 466. In some embodiments, the adhesive backing 470 is adhered to the heat-shrinkable film 430 with the first and second adhesive sections 474 and 476 adhered to locations of the heat-shrinkable film 430 on different sides of the weakened portion 466. After the heat-shrinkable film 430 is inverted at the transfer head 20, the adhesive backing 470 is then located on the inner side of the tube 456 of the heat-shrinkable film 430 and the weakened portion 466 is visible on the top of the tube 456. The adhesive backing 470 remains on the inner side of the heat-shrinkable film 430 when a heat-shrinkable package 434 is formed. The formation of the leading end seal 460 and the trailing end seal 458 in the heat-shrinkable film 430 by the end sealer 28 also causes the adhesive backing 470 to be cut. This leaves a strip of the adhesive backing 470 along the weakened portion 466 on the inner side of the heat-shrinkable package 434.

As the heat-shrinkable package 434 passes through the heat-shrink system 80, the heat-shrink environment within the heat-shrink system 80 causes the heat-shrinkable film 430 of the packages 434 to shrink around the objects 436 to form heat-shrunk packages 434' of heat-shrunk film 430'. In some embodiments, the film substrate 472 of the adhesive backing 470 does not shrink as much as the heat-shrinkable film 430 shrinks when exposed to the heat-shrink environment within the heat-shrink system 80. This difference in shrinkage rate may cause rippling of the heat-shrunk film 430' and/or the adhesive backing 470 when the heat-shrunk packages 434' are formed, but the adhesive backing 470 will still be adhered to the inner side of the heat-shrunk packages 434' if rippling occurs. In some embodiments, the heat-shrinkable film 430 and the film substrate 472 have substantially similar shrinkage rates (e.g., they are made from the same material) to reduce the occurrence of rippling during the heat-shrink process.

An embodiment of opening the heat-shrunk package 434' and repackaging it after it has been opened is depicted in a series of instances in FIGS. 9A to 9H. In those instances, various components are not drawn to scale, such as the thicknesses of the heat-shrunk film 430', the film substrate 472, the first adhesive section 474, and the second adhesive section 476, in order to make the components visible in the figures. In the instance depicted in FIG. 9A, the object 436 is packaged in the heat-shrunk package 434' with the adhesive backing 470 on the inner side of the heat-shrunk package 434' with the first and second adhesive sections 474 and 476 adhered to the heat-shrunk film 430' on opposite sides of the weakened portion 466. In the instance shown in FIG. 9A, the heat-shrunk package 434' can be sent to and received by a recipient.

Figure 9A:
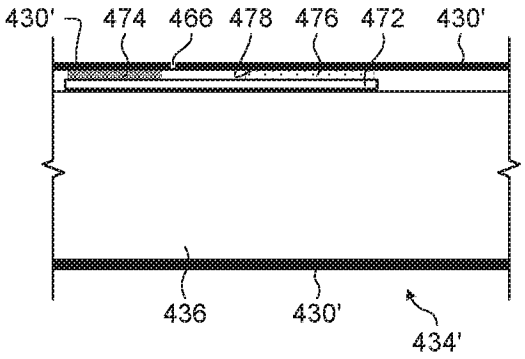
FIGS. 9A to 9H depict a series of instances of an embodiment of opening a heat-shrunk package and repackaging it after it has been opened, in accordance with the embodiments disclosed herein.
Figure 9B:
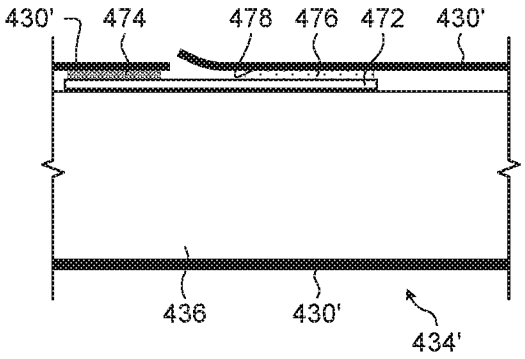

In FIG. 9B, the weakened portion 466 has been broken or torn. In some embodiments, the first and second adhesive sections 474 and 476 are spaced apart transversely on the film substrate 472 so that a flap of the heat-shrunk film 430' between the first and second adhesive sections 474 and 476 can be grasped after the weakened portion 466 has been broken or torn. In some embodiments, the weakened portion 466 is located closer to the first adhesive section 474 than to the second adhesive section 476 so that the flap of the heat-shrunk film 430' is wide enough to grasp after the weakened portion 466 has been broken or torn.

Figure 9C:
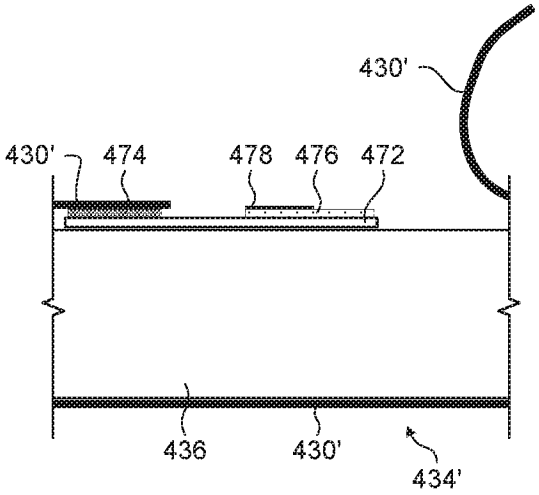

From the instance depicted in FIG. 9B, the flap of the heat-shrunk film 430' can be pulled back so that at least a portion of the heat-shrunk film 430' is no longer adhered to the second adhesive section 476, as shown in FIG. 9C. At that instance, at least a portion of the second adhesive section 476 is exposed. In the case where the adhesive backing 470 includes the removable liner 478, the removable liner 478 is also exposed. If the breaking of the weakened portion 466 was inadvertent and the flap of the heat-shrunk film 430' was also pulled back inadvertently (e.g., during shipping), the flap of the heat-shrunk film 430' could be placed back down over the adhesive backing 470 so that the flap of the heat-shrunk film 430' is adhered again to the second adhesive section 476. In this way, the adhesive backing 470 is usable to reclose the heat-shrunk package 434' if the heat-shrunk package 434' is inadvertently opened.

Figure 9D:
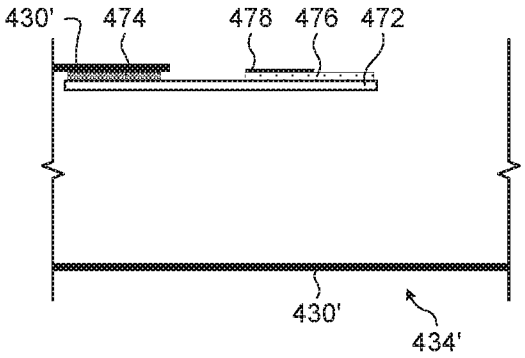
Figure 9F:
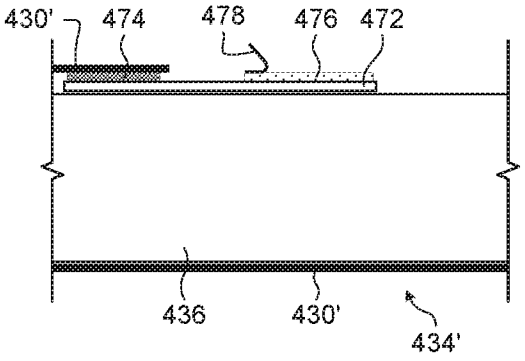
Figure 9E:
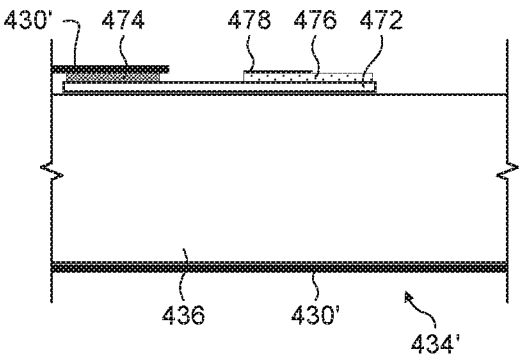

From the instance depicted in FIG. 9C, the flap of the heat-shrunk film 430' can be pulled back far enough to allow the object 436 to be removed from the heat-shrunk package 434', as shown in FIG. 9D. With the object 436 removed from the heat-shrunk package 434', the heat-shrunk package 434' can be discarded. Alternatively, the heat-shrunk package 434' can be reused. In the instance shown in FIG. 9E, the object 436 has been inserted back into the heat-shrunk package 434'. While the same object 436 is inserted back into the heat-shrunk package 434' in the embodiment shown in FIG. 9E, other objects can be inserted into the heat-shrunk package 434' to reuse the heat-shrunk package 434'.

In some embodiments, the process of removing the flap of the heat-shrunk film 430' from the second adhesive section 476 and re-adhering the flap of the heat-shrunk film 430' to the second adhesive section 476 has occurred multiple times before the object 436 is inserted back into the heat-shrunk package 434'. This repeated process may result in contamination of the exposed portion of the second adhesive section 476, and therefore the adhesive strength of the exposed portion of the second adhesive section 476 would be reduced. For example, dirt, dust, or other particles may have adhered to the exposed portion of the second adhesive section 476, resulting in a lower adhesive strength of the exposed second adhesive section 476. In the instance shown in FIG. 9F, the removable liner 478 is removed from the second adhesive section 476. Removing the removable liner 478 from the second adhesive section 476 exposes a portion of the adhesive that was previously covered by the removable liner 478. This freshly-exposed portion of the second adhesive section 476 is not contaminated in the same way as the other portion of the second adhesive section 476 and likely has a higher adhesive strength.

Figure 9H:
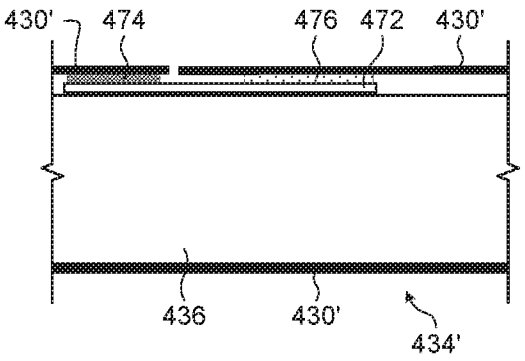
Figure 9G:
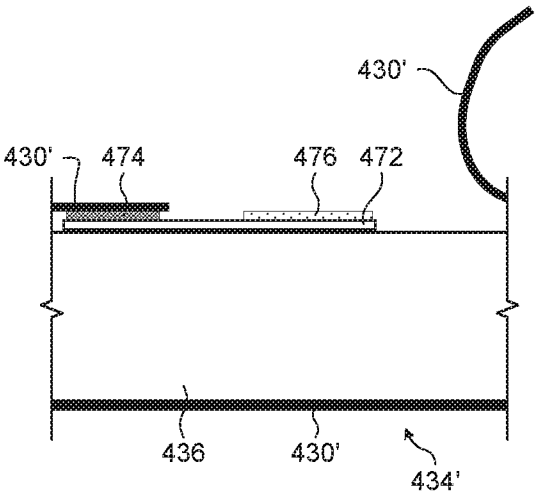

As shown in the instance depicted in FIG. 9G, the removable liner 478 is fully removed from the second adhesive section 476 and the flap of the heat-shrunk film 430' is brought back closer to the adhesive backing 470. As shown in the instance depicted in FIG. 9H, the flap of the heat-shrunk film 430' is then adhered to the second adhesive section 476 of the adhesive backing 470. In the case of the removable liner 478 having been removed to expose a fresh section of the second adhesive section 476, the freshly-exposed adhesive on the second adhesive section 476 provides added adhesive strength to keep the flap of the heat-shrunk film 430' closed. With the heat-shrunk package 434' in a closed state, as depicted in FIG. 9H, the heat-shrunk package 434' can be used to ship the object 436 again, such as shipping the object 436 back to the sender of the heat-shrunk package 434'.

Figure 10:
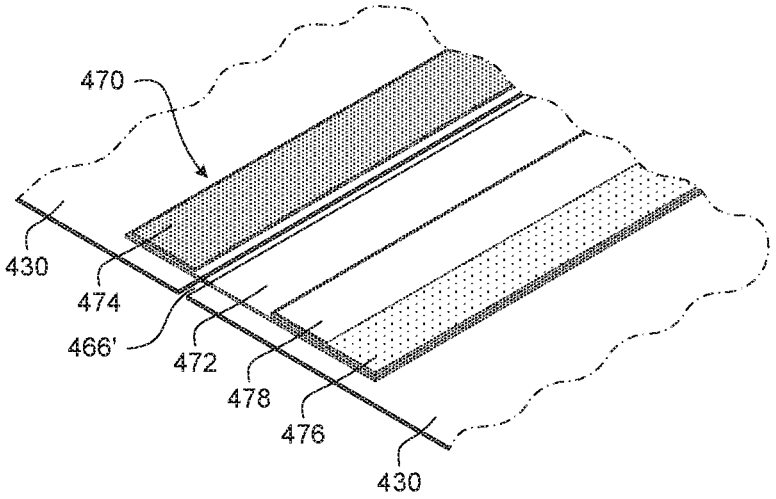
FIG. 10 depicts another embodiment of heat-shrinkable film and an adhesive backing, in accordance with the embodiments disclosed herein.

Depicted in FIG. 10 is another embodiment of the heat-shrinkable film 430 and the adhesive backing 470. In the depicted embodiment, the heat-shrinkable film 430 has a weakened portion 466' in the form of a slit. The slit extends longitudinally along the heat-shrinkable film 430 between the first and second adhesive sections 474 and 476 of the adhesive backing 470. The adhesive backing 470 can be adhered to the heat-shrinkable film 430 in the manner shown in the packaging system 410 depicted in FIG. 8C. Similarly, the embodiment of the heat-shrinkable film 430 and the adhesive backing 470 shown in FIG. 10 can be formed into heat-shrinkable packages 430 that are exposed to a heat-shrink environment to form heat-shrunk packages 434'. Once formed into heat-shrinkable packages 430 and/or heat-shrunk packages 434', the weakened portion 466' can be opened without having to break or tear the heat-shrinkable film 430 and/or the heat-shrunk film 430'.

Figure 11A:
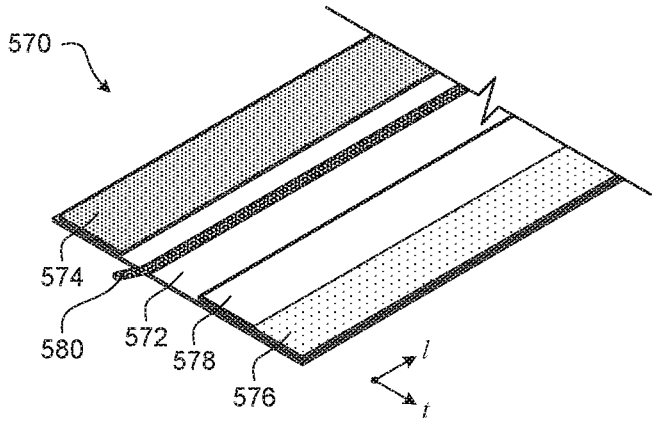
FIGS. 11A and 11B depict, respectively, another embodiment of an adhesive backing and a partial view of an embodiment of the adhesive backing adhered to a heat-shrinkable film, in accordance with the embodiments disclosed herein.

Depicted in FIG. 11A is another embodiment of an adhesive backing 570. The adhesive backing 570 includes a film substrate 572. In some embodiments, the film substrate 572 is formed from a heat-shrinkable material. In other embodiments, the film substrate 572 is formed from a material that does not substantially shrink when being exposed to a heat-shrink environment. The adhesive backing 570 includes a first adhesive section 574 that is applied longitudinally along the film substrate 572. In the depiction shown in FIG. 11A, the longitudinal direction is generally shown as the I-direction and the transverse direction is generally shown as the t-direction. In some embodiments, the longitudinally-applied first adhesive section 574 is substantially parallel to the length of the film substrate 572. The adhesive backing 570 also includes a second adhesive section 576 that is applied longitudinally along the film substrate 572 and is spaced apart transversely from the first adhesive section 574. In some embodiments, the longitudinally-applied second adhesive section 476 is substantially parallel to the length of the film substrate 572 and to the first adhesive section 574.

In some embodiments, the first and second adhesive sections 574 and 576 are double-sided adhesives with an adhesive one side (e.g., the bottom side in FIG. 11A) to adhere the first and second adhesive sections 574 and 576 to the film substrate 572 and an adhesive on the other side of the first and second adhesive sections 574 and 576 (e.g., the top side in FIG. 11A). In some embodiments, including the embodiment shown in FIG. 11A, the adhesive is exposed on the sides of the first and second adhesive sections 574 and 576 opposite the film substrate 572 (e.g., the top side on FIG. 11A). In some embodiments, the exposed adhesive on the sides of the first and second adhesive sections 574 and 546 opposite the film substrate 572 have different adhesive strengths. In some embodiments, the exposed adhesive on the first adhesive section 574 has a greater adhesive strength than the exposed adhesive on the second adhesive section 576. In some embodiments, after the exposed adhesive on the first adhesive sections 574 is adhered to a film, the first adhesive section 574 has an adhesive strength such that removal of the first adhesive section 574 from the film deforms the film. In some embodiments, after the exposed adhesive on the second adhesive sections 576 is adhered to a film, the second adhesive section 576 has an adhesive strength such that removal of the second adhesive section 476 from the film does not substantially deform the film. When used in combination, the first adhesive section 574 can be considered a "permanent adhesive" because the first adhesive section 574 is configured to remain adhered to the film unless the film is deformed and the second adhesive section 576 can be considered a "reclosable adhesive" because the second adhesive section 576 is configured to be removed from the film without deforming the film. In some embodiments, the reclosable adhesive of the second adhesive section 576 is configured to permit the film to be removed from the second adhesive section 576 and then re-adhered to the second adhesive section 576 multiple times without ceasing to still be adhesive.

In the depicted embodiment, the adhesive backing 570 also includes a pull tab 580 longitudinally applied to the film substrate 572 between the first adhesive section 574 and the second adhesive section 576. As will be discussed below, the pull tab 580 is configured to aid in breaking the heat-shrink film and/or heat-shrink film when the pull tab 580 is pulled from the film substrate 572. Pull tabs are known in art and may include flexible polypropylene, other polymers, yarns, filaments, any other suitable material, or any combination thereof.

As is depicted in FIG. 11A, the adhesive backing 570 also includes a removable liner 578 applied longitudinally along the second adhesive section 576. The removable liner 578 is narrower than the second adhesive section 576 in a transverse direction of the adhesive backing 570. As shown in the depicted embodiment, the narrower nature of the removable liner 578 leaves an area of the second adhesive section 576 exposed outside of the removable liner 578 in the longitudinal direction. The inclusion of the removable liner 578 in the adhesive backing 570 is optional, but can be useful if the adhesive backing 570 is used in a reclosable package.

Figure 11B:
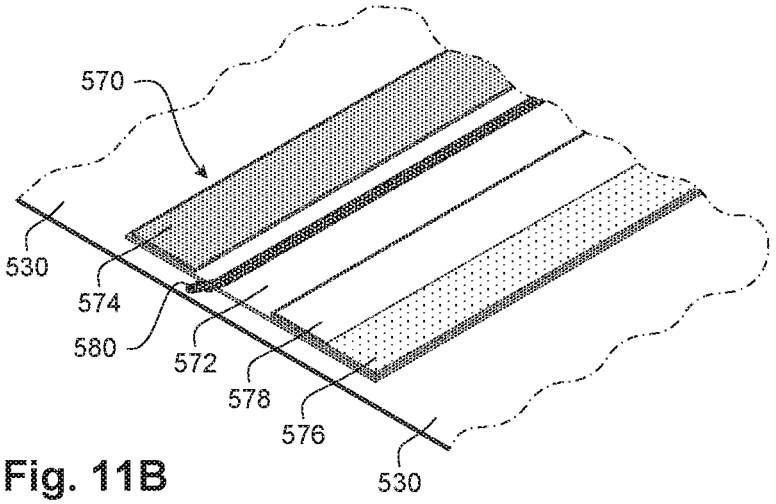

Depicted in FIG. 11B is a partial view of an embodiment of the adhesive backing 570 adhered to a heat-shrinkable film 530. The heat-shrinkable film 530 does not include a weakened portion. In the depicted embodiment, the adhesive backing 570 is adhered to the lower side of the heat-shrinkable film 530. In some embodiments, the heat-shrinkable film 530 includes an aperture through which the pull tab 580 can be fed so that a user can grasp the pull tab from the upper side of the heat-shrinkable film 530. From the position shown in FIG. 11B, the pull tab 580 can be pulled off of the film substrate 572 through the heat-shrinkable film 530 to break or tear the heat-shrinkable film 530. Alternatively, from the position shown in FIG. 11B, the heat-shrinkable film 530 can be formed into heat-shrunk film by exposure to a heat-shrink environment, and then the pull tab 580 can be pulled off of the film substrate 572 through the heat-shrunk film to break or tear the heat-shrunk film. In this last embodiment, the heat-shrunk film can form a heat-shrunk package around an object, and the pull tab 580 can be pulled off of the film substrate 572 through the heat-shrunk film to open the heat-shrunk package.

In some embodiments, the heat-shrinkable film 530 and the film substrate 572 are made from substantially the same material. In this way, the heat-shrinkable film 530 and the film substrate 572 will have substantially similar heat shrinkage rates when exposed to a heat-shrink environment. In some cases, the film substrate 572 and/or the heat-shrinkable film 530 will exhibit rippling after being exposed to a heat-shrink environment. This rippling can be due, in part, to differences in heat shrinkage rates of materials that are coupled to each other, such as a difference in heat shrinkage rate of the heat-shrinkable film 530 and the heat-shrinkage rates of the first and second adhesive sections 574 and 576. In some embodiments, the rippling effect can be reduced by forming the heat-shrinkable film 530 and the film substrate 572 from substantially the same material so that they have substantially similar heat shrinkage rates.

The adhesive backing 570 can be adhered to the heat-shrinkable film 530 in the manner shown in the packaging system 410 depicted in FIG. 8C. Similarly, the embodiment of the heat-shrinkable film 530 and the adhesive backing 570 shown in FIG. 11B can be formed into heat-shrinkable packages that are exposed to a heat-shrink environment to form heat-shrunk packages. Once formed into heat-shrinkable packages and/or heat-shrunk packages, the pull tab 580 can be used to open the heat-shrunk package. In addition, a heat-shrunk package opened using the pull tab 580 can be reused, similar to the process depicted in FIGS. 9C to 9H.

Figures 12A, 12B, 12C:
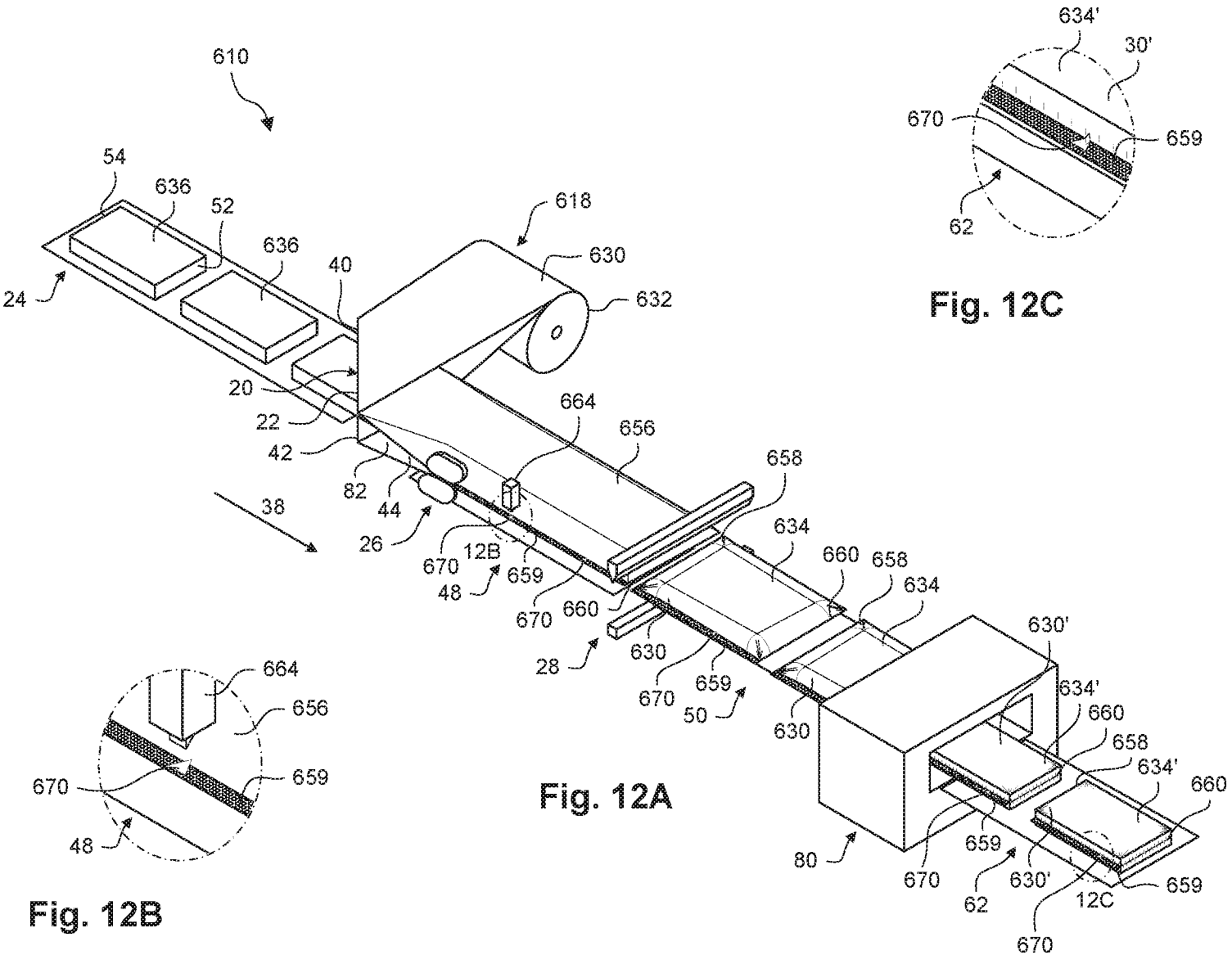
FIGS. 12A to 12C depict an embodiment of a packaging system configured to form an opening feature in one of a number of different-width seals and detail views thereof, in accordance with the embodiments disclosed herein.

In other embodiments, a heat-shrinkable package can have seals of different widths and a notch in one of the seals to provide an opening feature. FIG. 12A depicts an embodiment of a packaging system 610 configured to form an opening feature in one of a number of different-width seals. The packaging system 610 includes a number of components that are common to the components of the packaging system 10, and those components in common are similarly numbered in both the packaging system 10 and the packaging system 610. The packaging system 610 includes a shrink film dispenser 618 that supplies a web of heat-shrinkable film 630 from roll 632. In the depicted embodiment, the heat-shrinkable film 630 on the roll 632 is a center folded film.

Unlike some embodiments disclosed herein, the packaging system 610 includes does not form a weakened portion in the heat-shrinkable film 630, couple a protective film to the heat-shrinkable film 630, or use an adhesive backing on the heat-shrinkable film 630. After the heat-shrinkable film 630 is inverted at the transfer head 20, the longitudinal sealer 26 creates a longitudinal seal 659 to form a tube 656 of the heat-shrinkable film 630. In the depicted embodiment, the longitudinal seal 659 is wider that the other longitudinal seals described herein (e.g., the longitudinal seal 59). While traditional seal design attempts to make seals as thin as possible, the longitudinal seal 659 is intentionally wider than a typical seal.

The packaging system 610 includes a punch 664 configured to form a notch 670 in the longitudinal seal 659. The punch 664 and the notch 670 are depicted in greater detail in the sectional view shown in FIG. 12B. The notch 670 is configured to permit the longitudinal seal 659 to be broken to initiate propagation of a tear in the heat-shrinkable film 630 in response to the notch 670 being pulled. In the depicted embodiment, the notch 670 extends from the longitudinal seal 659 onto an unsealed portion of the heat-shrinkable film 630. In the depicted embodiment, the notch 670 has a triangular shape. In other embodiments, the notch 670 can have any other shape, such as a rectangular shape, a trapezoidal shape, rhombus shape, a teardrop shape, any other shape, or any combination thereof.

The tube 656 of the heat-shrinkable film 630 is formed into a heat-shrinkable package 634 by the end sealer 28 forming a leading end seal 660 and a trailing end seal 658 on opposite sides of the object 636. In the depicted embodiment, the longitudinal seal 659 includes one notch 670, though it could include more than one notch in other embodiments. In the depicted embodiment, the longitudinal seal 659 is wider than either of the transverse seals (i.e., the end seal 660 or the trailing end seal 658). However, in other embodiments, the end sealer 28 could be configured to form one or both of the of the trailing and leading end seals 658 and 660 wider than the longitudinal seal 259. In such a case, the punch 664 may be integrated with the end sealer 28 so that the end sealer 28 is configured to cut the heat-shrinkable film 630, form the trailing and leading end seals 658 and 660, and punch the notch 670 in one of the trailing and leading end seals 658 and 660 at substantially the same time.

As the heat-shrinkable packages 634 passes through the heat-shrink system 80, the heat-shrink environment within the heat-shrink system 80 causes the heat-shrinkable film 630 of the heat-shrinkable packages 634 to shrink around the objects 636 to form heat-shrunk packages 634' of heat-shrunk film 630'. The notch 670 remains in the longitudinal seal 659 after the heat-shrinkable package 634 is formed into the heat-shrunk package 634', as depicted in greater detail in FIG. 12C. After the heat-shrunk package 634' is formed, the notch 670 is configured to permit the longitudinal seal 659 to be broken to initiate propagation of a tear in the heat-shrunk package 634' in response to the notch 670 being pulled.

Figure 13A:
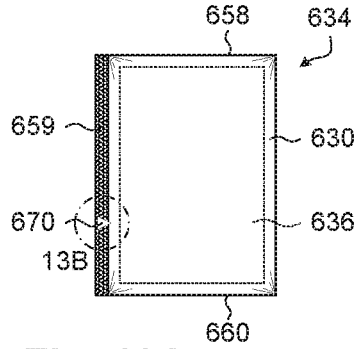
FIGS. 13A to 13D depict embodiment of a heat-shrinkable package with seals of different widths and a notch in one of the seals, in accordance with the embodiments disclosed herein.
Figure 13B:
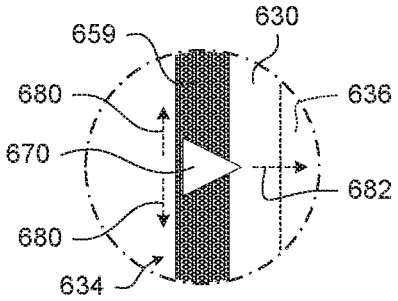

Many different embodiments exist of the location, shape, and mode of operation of a notch in a heat-shrunk package. Depicted in FIGS. 13A and 13B are the embodiment of the heat-shrinkable package 634 and the notch 670. As depicted, the notch 670 is formed in the longitudinal seal 659 and extends into the unsealed portion of the heat-shrinkable film 630. While the notch 670 has a triangular shape in the depicted embodiment, the notch 670 could have any other shape or size. As shown in FIG. 13B, the notch 670 can be pulled in directions 680 that cause the longitudinal seal 659 to be broken to initiate propagation of a tear in the heat-shrinkable package 634. In the depicted embodiment, a tear can be initiated in a direction 682 that is substantially perpendicular to the longitudinal seal 659 in response to the notch 670 being pulled in the directions 680. While the embodiment in FIGS. 13A and 13B is shown in the form of a heat-shrinkable package 634, the notch 670 in the heat-shrunk package 634' could likewise be pulled in the directions 680 to cause the longitudinal seal 659 to be broken to initiate propagation of a tear in the heat-shrunk film 630' in the direction 682.

Figure 13C:
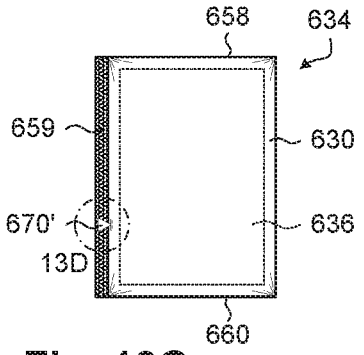
Figure 13D:
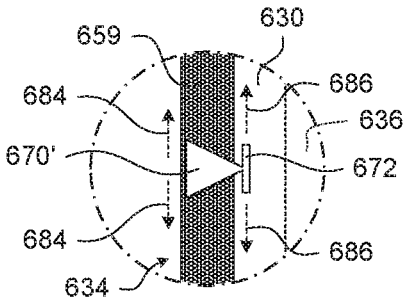

Depicted in FIGS. 13C and 13D is the heat-shrinkable package 634 with another embodiment of a notch 670'. As depicted, the notch 670' is formed in the longitudinal seal 659 and extends into the unsealed portion of the heat-shrinkable film 630. The notch 670' also has a feature 672 in the unsealed portion of the heat-shrinkable film 630. The feature 672 of the notch 670' encourages propagation of the tear in the heat-shrinkable film 630 along the longitudinal seal 659 in directions 686 in response to the notch 670' being pulled in directions 684. While the notch 670' and the feature have triangular and rectangular shapes, respectively, in the depicted embodiment, the notch 670' and the feature 672 could have any other shape or size. As shown in FIG. 13D, the notch 670' can be pulled in directions 684 that cause the longitudinal seal 659 to be broken to initiate propagation of a tear in the heat-shrinkable package 634 in response to the notch 670 being pulled. In the depicted embodiment, a tear can be initiated in the directions 686 that are substantially parallel to the longitudinal seal 659. While the embodiment in FIGS. 13C and 13D are shown in the form of a heat-shrinkable package 634, the notch 670' in the heat-shrunk package 634' could likewise be pulled in the directions 684 to cause the longitudinal seal 659 to be broken to initiate propagation of a tear in the heat-shrunk film 630' in the directions 686.

Figure 14A:
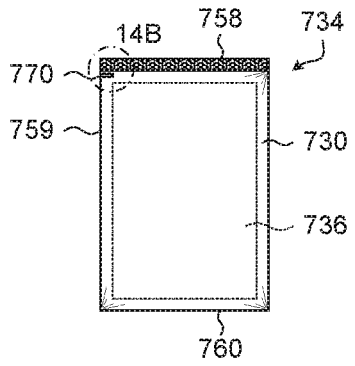
FIGS. 14A and 14B depict another embodiment of a heat-shrinkable package with seals of different widths and a notch in one of the seals, in accordance with the embodiments disclosed herein.
Figure 14B:
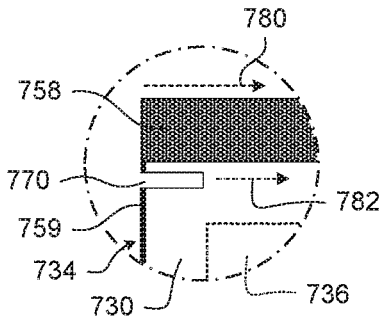

Depicted in FIGS. 14A and 14B is an embodiment of a heat-shrinkable package 734 with an embodiment of a notch 770. The heat-shrinkable package 734 is formed from heat-shrinkable film 730 that is sealed to itself at a trailing transverse end seal 758, a longitudinal seal 759, and a leading transverse end seal 760. The trailing transverse end seal 758 is wider than the longitudinal seal 759. The notch 770 is formed in the longitudinal seal 759 in a rectangular shape that is substantially parallel to the trailing transverse end seal 758. A portion of the notch 770 extends into the unsealed portion of the heat-shrinkable film 730. While the notch 770 has a triangular shape in the depicted embodiment, the notch 770 could have any other shape or size. As shown in FIG. 14B, the notch 770 can be pulled in a direction 780 that causes the longitudinal seal 759 to be broken to initiate propagation of a tear in the heat-shrinkable package 734. In the depicted embodiment, a tear can be initiated in the direction 782 that is substantially parallel to the trailing transverse end seal 758. While the embodiment in FIGS. 14A and 14B are shown in the form of a heat-shrinkable package 734, the heat-shrinkable package 734 can be exposed to a heat-shrink environment to cause the heat-shrinkable package 734 to shrink and form a heat-shrunk package. The notch 770 in the heat-shrunk package could likewise be pulled in the direction 780 to cause the longitudinal seal 759 to be broken to initiate propagation of a tear in the heat-shrunk film in the direction 782.

Figure 15A:
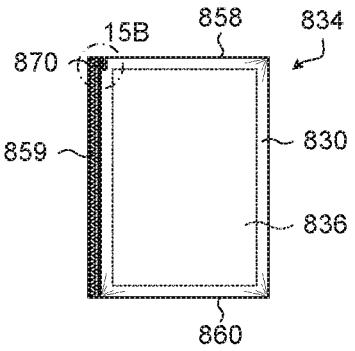
FIGS. 15A and 15B depict another embodiment of a heat-shrinkable package with seals of different widths and a notch in one of the seals, in accordance with the embodiments disclosed herein.
Figure 15B:
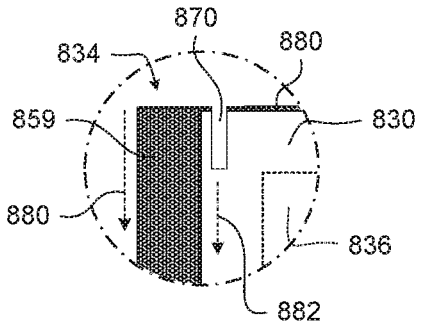

Depicted in FIGS. 15A and 15B is an embodiment of a heat-shrinkable package 834 with an embodiment of a notch 870. The heat-shrinkable package 834 is formed from heat-shrinkable film 830 that is sealed to itself at a trailing transverse end seal 858, a longitudinal seal 859, and a leading transverse end seal 860. The longitudinal seal 859 is wider than the trailing transverse seal 858. The notch 870 is formed in the trailing transverse seal 858 in a rectangular shape that is substantially parallel to the longitudinal seal 859. A portion of the notch 870 extends into the unsealed portion of the heat-shrinkable film 830. While the notch 870 has a rectangular shape in the depicted embodiment, the notch 870 could have any other shape or size. As shown in FIG. 15B, the notch 870 can be pulled in a direction 880 that causes the longitudinal seal 859 to be broken to initiate propagation of a tear in the heat-shrinkable package 834. In the depicted embodiment, a tear can be initiated in the direction 882 that is substantially parallel to the longitudinal seal 859. While the embodiment in FIGS. 15A and 15B are shown in the form of a heat-shrinkable package 834, the heat-shrinkable package 834 can be exposed to a heat-shrink environment to cause the heat-shrinkable package 834 to shrink and form a heat-shrunk package. The notch 870 in the heat-shrunk package could likewise be pulled in the direction 880 to cause the longitudinal seal 859 to be broken to initiate propagation of a tear in the heat-shrunk film in the direction 882.

For purposes of this disclosure, terminology such as "upper," "lower," "vertical," "horizontal," "inwardly," "outwardly," "inner," "outer," "front," "rear," and the like, should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Unless stated otherwise, the terms "substantially," "approximately," and the like are used to mean within 5% of a target value.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

What is claimed is:

1. A method of packaging an object, comprising:

forming a package of heat-shrinkable film around an object, the heat-shrinkable film including a weakened portion;

coupling a protective film to the heat-shrinkable film, wherein the protective film is positioned to cover the weakened portion in the heat-shrinkable film; and exposing the package of heat-shrinkable film and the protective film to a heat-shrink environment configured to cause the package of heat-shrinkable film to shrink and form a package of heat-shrunk film around the object;

wherein the protective film is positioned to cover the weakened portion in the heat-shrunk film after exposing the package of heat-shrinkable film and the protective film to the heat-shrink environment; and wherein forming the package of heat-shrinkable film around the object comprises:

feeding the heat-shrinkable film in a Z-folded state having a major fold and a minor fold; and forming a longitudinal seal between a first end of the heat-shrinkable film and the minor fold to form a tunnel of the heat-shrinkable film.

2. The method of claim 1, wherein the heat-shrunk film is substantially opaque.

3. The method of claim 1, wherein the heat-shrinkable film and the protective film are formed from substantially the same material.

4. The method of claim 1, wherein the protective film is made from a material that shrinks less than the shrinkage of the heat-shrinkable film during exposure to the heat-shrink environment.

5. The method of claim 1, wherein the protective film is formed from the heat-shrinkable film between the minor fold and a second end of the heat-shrinkable film.

6. The method of claim 5, wherein the weakened portion is located in the heat-shrinkable film between the minor fold and the major fold under the protective film.

7. The method of claim 5, further comprising:

forming a transverse leading seal and a transverse trailing seal on opposite sides of the object;

wherein each of the transverse leading seal and the transverse trailing seal seals a portion of the heat-shrinkable film between the first end and the major fold, a portion of the heat-shrinkable film between the major fold and the minor fold, and a portion of the heat-shrinkable film between the minor fold and the second end.

8. A method of packaging an object, comprising:

forming a package of heat-shrinkable film around an object, the heat-shrinkable film including a weakened portion;

coupling a protective film to the heat-shrinkable film, wherein the protective film is positioned to cover the weakened portion in the heat-shrinkable film; and exposing the package of heat-shrinkable film and the protective film to a heat-shrink environment configured to cause the package of heat-shrinkable film to shrink and form a package of heat-shrunk film around the object;

wherein the protective film is positioned to cover the weakened portion in the heat-shrunk film after exposing the package of heat-shrinkable film and the protective film to the heat-shrink environment;

wherein coupling the protective film to the heat-shrinkable film comprises:

feeding the protective film along the heat-shrinkable film so that the protective film covers the weakened portion in the heat-shrinkable film before forming the package of heat-shrinkable film; and wherein forming the package of heat-shrinkable film around the object comprises:

forming a transverse leading seal and a transverse trailing seal on opposite sides of the object;

wherein the transverse leading seal seals a first end of the protective film to the heat-shrinkable film and wherein the transverse trailing seal seals a second end of the protective film to the heat-shrinkable film.

9. The method of claim 8, wherein the heat-shrinkable film and the protective film are formed from substantially the same material.

10. The method of claim 8, wherein the protective film is made from a material that shrinks less than the shrinkage of the heat-shrinkable film during exposure to the heat-shrink environment.

* * * * *